US010998657B2

(12) United States Patent
Esmaeili et al.

(10) Patent No.: US 10,998,657 B2
(45) Date of Patent: May 4, 2021

(54) PRECIOUS-METAL-ALLOY CONTACTS

(71) Applicant: Apple Inc., Cupertino, CA (US)

(72) Inventors: Hani Esmaeili, Santa Clara, CA (US); Kenneth Michael Bagwell, Sunnyvale, CA (US); Holly Ubellacker, Georgetown, KY (US); Judy Hsien-Chih Liu, New Taipei (TW); Eric S. Jol, San Jose, CA (US); Christoph Bitterlich, Sunnyvale, CA (US); Michael W. Barnstead, Pleasanton, CA (US); Christoph Werner, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/565,336

(22) Filed: Sep. 9, 2019

(65) Prior Publication Data

US 2020/0006880 A1 Jan. 2, 2020

Related U.S. Application Data

(63) Continuation-in-part of application No. 15/464,051, filed on Mar. 20, 2017, now Pat. No. 10,411,379.

(60) Provisional application No. 62/384,120, filed on Sep. 6, 2016, provisional application No. 62/383,381, filed (Continued)

(51) Int. Cl.
*H01R 13/03* (2006.01)
*H01R 43/16* (2006.01)

(52) U.S. Cl.
CPC ..... *H01R 13/03* (2013.01); *H01R 43/16* (2013.01); *H01R 13/035* (2013.01)

(58) Field of Classification Search
CPC ..... H01R 13/03; H01R 13/035
See application file for complete search history.

(56) References Cited

U.S. PATENT DOCUMENTS 4,747,783 A 5/1988 Bellamy
5,175,928 A * 1/1993 Grabbe ..... H01R 12/727 29/884

(Continued)

FOREIGN PATENT DOCUMENTS

DE 2020170014254 7/2017
JP 2006108057 4/2006

(Continued)

OTHER PUBLICATIONS

Korean Application No. 20-2017-0001277, Office Action dated Jun. 29, 2018, 13 pages (6 pages of English translation and 7 pages of official).

*Primary Examiner* — Tho D Ta
(74) *Attorney, Agent, or Firm* — Kilpatrick Townsend & Stockton, LLP

(57) ABSTRACT

Contacts that can be highly corrosion resistant, can be readily manufactured, and can conserve precious materials. One example can provide contacts having a layer of a precious-metal alloy to improve corrosion resistance. The precious-metal-alloy layer can be plated with a hard, durable, wear and corrosion resistant plating stack for further corrosion resistance and wear improvement. The resources consumed by a contact can be reduced by forming a bulk or substrate region of the contact using a more readily available material, such as copper or a material that is primarily copper based.

23 Claims, 34 Drawing Sheets

Related U.S. Application Data on Sep. 2, 2016, provisional application No. 62/310, 445, filed on Mar. 18, 2016.

(56) References Cited

U.S. PATENT DOCUMENTS

| | | | | |
|---|---|---|---|---|
| 5,209,987 | A * | 5/1993 | Penneck | C23C 14/027 428/457 |
| 6,215,670 | B1 | 4/2001 | Khandros | |
| 6,335,107 | B1 | 1/2002 | Abys | |
| 6,666,713 | B1 | 12/2003 | Norvelle | |
| 6,767,219 | B2 | 7/2004 | Maruyama | |
| 6,849,177 | B2 * | 2/2005 | Murata | B01J 19/123 210/192 |
| 7,030,325 | B2 | 4/2006 | Blossfeld | |
| 8,637,165 | B2 * | 1/2014 | Siahaan | H01R 13/03 428/675 |
| 8,747,155 | B2 | 6/2014 | Weber | |
| 8,936,857 | B2 | 1/2015 | Dadvand | |
| 9,330,804 | B2 | 5/2016 | Shibuya | |
| 2006/0105641 | A1 | 5/2006 | Rehbein | |
| 2009/0081477 | A1 | 3/2009 | Kobayashi | |
| 2009/0263678 | A1 | 10/2009 | Sasaoka | |
| 2012/0141820 | A1 | 6/2012 | Chang | |
| 2013/0084758 | A1 | 4/2013 | Mizuta | |
| 2013/0084759 | A1 | 4/2013 | Mizuta | |
| 2013/0084760 | A1 | 4/2013 | Siahaan et al. | |
| 2014/0017393 | A1 | 1/2014 | Schmidt | |
| 2014/0073201 | A1 | 3/2014 | Weber et al. | |
| 2015/0194746 | A1 | 7/2015 | Shibuya | |
| 2016/0254608 | A1 | 9/2016 | Takahashi | |
| 2016/0340786 | A1 | 11/2016 | Mukai | |
| 2017/0253008 | A1 | 9/2017 | Cahalen | |
| 2017/0271800 | A1 | 9/2017 | Wagman | |

FOREIGN PATENT DOCUMENTS

| | | |
|---|---|---|
| JP | 2015048512 | 3/2015 |
| JP | 3211820 | 11/2017 |

* cited by examiner

PRECIOUS-METAL-ALLOY CONTACTS

CROSS-REFERENCES TO RELATED APPLICATIONS

This application is a continuation-in-part of U.S. patent application Ser. No. 15/464,051, filed Mar. 20, 2017, which claims the benefit of U.S. patent application Nos. 62/310,445, filed Mar. 18, 2016, 62/383,381, filed Sep. 2, 2016, and 62/384,120, filed Sep. 6, 2016; which are incorporated by reference.

BACKGROUND

Electronic devices often include one or more connector receptacles though which they may provide and receive power and data. Power and data can be conveyed over cables that include a connector insert at each end of a cable. The connector inserts can be inserted into receptacles in the communicating electronic devices. In other electronic systems, contacts on a first device can be in direct contact with contacts on a second device without the need for an intervening cable. In such systems, a first connector can be formed as part of the first electronic device and a second connector can be formed as part of the second electronic device.

The contacts in these various connectors may be exposed to liquids and fluids that can cause the contacts to corrode. For example, a user may purposely or inadvertently submerge an electronic device or a connector insert in a liquid. A user may spill a liquid or perspire on contacts on an electronic device or connector insert. This can cause one or more contacts to corrode, particularly where a voltage is present on the one or more contacts. This corrosion can impair the operation of the electronic device or cable and in severe cases can render the device or cable inoperable. Even where operation is not impaired, corrosion can mar the appearance of the contacts. Where the contacts are at the surface of an electronic device or at the surface of a connector insert on a cable, such corrosion can be readily apparent to a user and it may create a negative impression in the mind of a user that can reflect poorly on the device or cable and the device or cable's manufacturer.

Some of these electronic devices may be very popular and can therefore be manufactured in great numbers. Therefore, it may be desirable that these contacts be readily manufactured such that demand for the devices can be met. It may also be desirable to reduce the consumption of rare or precious materials.

Thus, what is needed are contacts that can be highly corrosion resistant, can be readily manufactured, and can conserve precious materials.

SUMMARY

Accordingly, embodiments of the present invention can provide contacts that can be highly corrosion resistant, can be readily manufactured, and can conserve precious materials. These contacts can be located at a surface of an electronic device, at a surface of a connector insert, in a connector insert on a cable, in a connector receptacle on an electronic device, or elsewhere in a connector system.

An illustrative embodiment of the present invention can provide connector contacts that include a layer or portion formed of a precious-metal alloy to improve corrosion resistance. The precious-metal-alloy layer can be plated for further corrosion resistance and wear improvement.

Resources can be conserved by forming a bulk or substrate region of the contact using a more common material, such as copper or a material that is primarily copper based. The combination of a precious-metal alloy and a more common bulk or substrate region can provide contacts having both improved corrosion resistance and a lower overall precious resource consumption.

In these and other embodiments of the present invention, the precious-metal-alloy layer or contact portion can be formed of a high-entropy material. Examples of this material can include material consistent with ASTM Standards B540, B541, B563, B589, B683, B685, or B731, yellow gold, or other materials. The material for the precious-metal-alloy layer can be selected to have a good hardness and strength, as well as a high conductivity or low electrical resistance such that contact resistance is reduced. In various embodiments of the present invention, the precious-metal-alloy layer can have a Vickers hardness below 100, between 100-200, between 200-300, over 300, or a hardness in another range. A material having a good formability and high elongation for improved manufacturability can be selected for use as the precious-metal alloy. In these and other embodiments of the present invention, a precious-metal-alloy layer can have a thickness less than 10 micrometers, more than 10 micrometers, from 10 micrometers to 100 micrometers, from 10 micrometers to hundreds of micrometers, more than 100 micrometers, from 100 micrometers to hundreds of micrometers, or it can have a thickness in a different range of thicknesses. In these and other embodiments of the present invention, portions of, or all of a contact, can be formed of a precious-metal alloy.

In these and other embodiments of the present invention, the precious-metal-alloy layer can be clad over a substrate formed of a more common material, though in other embodiments of the present invention, portions of, or all of a contact, can be formed of a precious-metal alloy. This substrate can be formed using a material that is copper or copper based, such as phosphor bronze. In these and other embodiments of the present invention, the substrate can be formed using copper-nickel-tin, copper-nickel-silver alloy, steel, or other appropriate material or alloy. Material having good electrical conductivity and a good availability can be selected for use to form the contact substrate. The material can also be selected to have a good formability, elongation, and hardness that are similar to that of the material used for the precious-metal-alloy layer. In various embodiments of the present invention, the substrate layer can have a Vickers hardness below 100, between 100-200, between 200-300, over 300, or a hardness in another range. In these and other embodiments of the present invention, the bulk or substrate layer can form the majority of the contact and can have a thickness less than 1 mm, more than 1 mm, between 0.5 mm and 1.5 mm, approximately 1.0 mm, between 1 mm and 10 mm, more than 10 mm, or it can have a thickness in a different range of thicknesses.

In these and other embodiments of the present invention, a diffusion or bonding layer can be formed when the precious-metal alloy is bonded or clad to the substrate. This bonding layer can be an intermetallic bond of the precious-metal alloy and the alloy of the substrate. This diffusion or bonding layer can be less than 1 micrometer, more than 1 micrometer, 1 to 5 micrometers, 5 micrometers, or more than 5 micrometers thick.

In these and other embodiments of the present invention, one or more intermediate layers can be placed between the precious-metal-alloy layer and the substrate. These intermediate layers can have better corrosion resistance than copper and can also be more readily available than the material used as the precious-metal alloy. The one or more intermediate layers can be formed using titanium, steel, tantalum, or other material. This material can be selected based on its availability, formability, elongation, hardness, conductivity, ability to be stamped, or other property.

In these and other embodiments of the present invention, the precious-metal-alloy layer can be plated with a hard, durable, wear and corrosion resistant plating stack. This stack can be formed of one or more plating layers.

A first plating layer can be plated over the precious-metal-alloy layer for leveling and adhesion. For example, gold, copper, or other material can act as a leveler and tend to fill vertical differences across a surface of the precious-metal-alloy layer. This can help to cover defects in the substrate, such as nodules or nodes that can be left behind by an electropolish or chemical polishing step. This first plating layer can also provide adhesion between the precious-metal-alloy layer and a second plating layer or top plate. Instead of gold or copper, the first plating layer can be formed of nickel, tin, tin copper, hard gold, gold cobalt, or other material, though in other embodiments of the present invention, the first plating layer can be omitted. This first plating layer can have a thickness less than 0.01 micrometers, between 0.01 and 0.05 micrometers, between 0.05 and 0.1 micrometers, between 0.0.5 and 0.15 micrometers, more than 0.1 micrometers, or it can have a thickness in a different range of thicknesses.

In these and other embodiments of the present invention, a top plate can be plated over the first plating layer. The top plate can provide a durable contacting surface for when the contact on the electronic device housing the contact is mated with a corresponding contact on a second electronic device. In various embodiments of the present invention, the top plate can have a Vickers hardness below 100, between 100-200, between 200-300, over 300, or a hardness in another range. The top plate can be formed using rhodium-ruthenium, dark rhodium, dark ruthenium, gold copper, or other alternatives. The use of rhodium-ruthenium or rhodium can help oxygen formation, which can reduce its corrosion. The percentage of rhodium can be between 85 to 100 percent by weight, for example, it can be 95 or 99 percent by weight, where the most or all of the remaining material is ruthenium. This material can be chosen for its color, wear, hardness, conductivity, scratch resistance, or other property. This top plate can have a thickness less than 0.5 micrometers, between 0.5 and 0.75 micrometers, between 0.75 and 0.85 micrometers, between 0.85 and 1.1 micrometers, more than 1.1 micrometers, or it can have a thickness in a different range of thicknesses.

In these and other embodiments of the present invention, instead of a top plate being plated over the first plating layer, a second plating layer can be plated over the first plating layer. The second plating layer can act as a barrier layer to prevent color leakage from the precious-metal-alloy layer to the surface of the contact, and the material used for the second plating layer can be chosen on this basis. In these and other embodiments of the present invention, the second plating layer can be formed using nickel, palladium, tin-copper, silver, or other appropriate material. The use of palladium or other material can provide a second plating layer that is more positively charged than a top plate of rhodium-ruthenium, rhodium, or other material. This can cause the top plate to act as a sacrificial layer, thereby protecting the underlying palladium. This second plating layer can have a thickness less than 0.1 micrometers, between 0.1 and 0.5 micrometers, between 0.5 and 1.0 micrometers, between 1.0 and 1.5 micrometers, more than 1.0 micrometers, or it can have a thickness in a different range of thicknesses.

In these and other embodiments of the present invention, the first plating layer can be omitted and the second plating layer can be plated directly on the precious-metal layer.

In these and other embodiments of the present invention, a third plating layer can be plated over the second plating layer. The third plating layer may, like the first plating layer, provide leveling and adhesion. For example, gold can tend to fill vertical differences across a surface of the second plating layer, the barrier layer, and can provide adhesion between the second plating layer and a top plate. For example, a gold plating layer can provide adhesion between a second plating layer of palladium and a top plate of rhodium-ruthenium. The gold layer can be a plated gold strike. Instead of gold, the third plating layer can be formed of nickel, copper, tin, tin copper, hard gold, gold cobalt, or other material. This third plating layer can have a thickness less than 0.01 micrometers, between 0.01 and 0.05 micrometers, between 0.05 and 0.1 micrometers, between 0.05 and 0.15 micrometers, more than 0.1 micrometers, or it can have a thickness in a different range of thicknesses.

In these and other embodiments of the present invention, the third plating layer can be omitted and the top plate can be plated directly on the second plating layer.

In these and other embodiments of the present invention, the top plate described above can be plated over the third plating layer.

In these and other embodiments of the present invention, the plating materials used can be selected based a desire to conserve precious resources, formability, elongation, hardness, conductivity, ability to be stamped, or other property.

These contacts can be formed in various ways in various embodiments of the present invention. In an illustrative embodiment of the present invention, a layer of precious-metal alloy can at least partially cover a layer of substrate material. As described herein, one or more intermediate layers can be placed between the layer of precious-metal alloy and the substrate. Contacts can be stamped such that a precious-metal-alloy layer can be clad to a bulk or substrate layer, or over the bulk or substrate layer with one or more intermediate layers. The materials used can be heated (and possibly annealed) and elongated during the stamping. For example, a 35, 50, or 70 percent elongation can be used.

In these and other embodiments of the present invention, carriers can be stamped of the bulk material. These carriers can be used to carry or otherwise manipulate the contacts during further manufacturing steps, such as blasting, polishing, sanding, plating (for example, as described herein), further annealing, or other process steps.

In these and other embodiments of the present invention, the layer of precious-metal alloy can be placed on a top surface of a layer of bulk or substrate material before stamping. In other embodiments of the present invention, one or more grooves can be formed in the layer of bulk or substrate material and the layer of precious-metal alloy can be placed in the one or more grooves. In these and other embodiments of the present invention, one or more of the grooves can be deeper than one or more of the remaining grooves. In this way a layer of precious-metal alloy in a contact can have a greater depth along at least a portion of the sides of the contact. This can help to improve corrosion resistance along sides of the resulting contacts.

In these and other embodiments of the present invention, contacts can be formed in other ways and have different plating layers. For example, strips of a copper alloy or other material can be butt-welded or otherwise fixed or attached to sides of a strip of a precious-metal alloy to form a strip or roll of material for stamping. Contacts can be stamped such that all of the contact is formed of the precious-metal alloy while a carrier is formed of the copper alloy or other material. Contacts can also be stamped such that only portions, such as a contacting portion, are formed of the precious-metal alloy while the remainder of the contact and a carrier can be formed of the copper alloy or other material in order to conserve resources.

These and other embodiments of the present invention can include various plating layers at a contacting portion or other portion of a contact. In one example a contact substrate can be stamped, for example from a sheet or strip of copper, or a strip that includes strips of copper welded to sides of a strip of a precious-metal alley. An electropolish step can be used to removing stamping burrs, which could otherwise expose nickel silicides or other particles in the substrate. Unfortunately, the electropolish step can leave nodules on the contact surface. Chemical polish can be used in its place, though that can leave nodes behind on the contact surface.

Accordingly, a first plating layer to provide a surface leveling can be plated on the substrate. This first plating layer can be copper or other material, such as gold, nickel, tin, tin copper, hard gold, or gold cobalt, and it can be plated over the contact substrate to level the surface of the stamped substrate and cover nodules left by electropolishing or nodes left by chemical polishing as well as remaining burrs or other defects from the stamping process. In these other embodiments of the present invention, the first plating layer can be sufficient and an electropolish step can be omitted. The first plating layer can also provide adhesion between the substrate and a second plating layer that can be plated over the first plating layer. The first plating layer can have a thickness of 0.5 to 1.0 micrometers, 1.0 to 3.0 micrometers, 3.0 to 4.5 micrometers, 3.0 to 5.0 micrometers, or more than 5.0 micrometers, or it can have a thickness in a different range of thicknesses.

Cracks in these plating layers can provide pathways for fluids that can cause corrosion. Accordingly, a second, harder plating layer to prevent layers above the second plating layer from cracking can be plated over the first plating layer. This second plating layer can be formed of an electroless nickel composite. This second plating layer can have a thickness of 0.5 to 1.0 micrometers, 1.0 to 2.0 micrometers, 2.0 to 5.0 micrometers, or more than 5.0 micrometers, or it can have a thickness in a different range of thicknesses. In various embodiments of the present invention, this second layer can be omitted.

A third plating layer can work in conjunction with the second plating layer. The third plating layer can be plated over the second plating layer. This third plating layer can be soft to absorb shock and thereby minimize cracking in the layers above the third plating layer. The third plating layer can be gold or other material such as copper, nickel, tin, tin copper, hard gold, or gold cobalt. The third plating layer can provide adhesion between its neighboring layers and can provide a leveling effect as well. This third plating layer can have a thickness of 0.55 to 0.9 micrometers, 0.5 to 1.25 micrometers, 1.25 to 2.5 micrometers, 2.5 to 5.0 micrometers, or more than 5.0 micrometers, or it can have a thickness in a different range of thicknesses. In various embodiments of the present invention, these second and third plating layers can be omitted, or the second layer can be omitted, though other layers can be added or omitted as well.

A fourth plating layer to provide corrosion resistance can be plated over the third plating layer. The fourth plating layer can act as a barrier layer to prevent color leakage to the surface of the contact, and the material used for the fourth plating layer can be chosen on this basis. This layer can be formed of palladium or other material such as nickel, tin-copper, or silver. The use of palladium or other material can provide a second plating layer that is more positively charged than a top plate of rhodium-ruthenium, rhodium, or other material. This can cause the top plate to act as a sacrificial layer, thereby protecting the underlying palladium. This layer can be somewhat harder than a fifth plating layer above it, which can prevent layers above the fourth plating layer from cracking when exposed to pressure during a connection. The fourth plating layer can have a thickness of 0.5 to 0.8 micrometers, 0.5 to 1.0 micrometers, 1.0 to 1.5 micrometers, 1.5 to 3.0 micrometers, or more than 3.0 micrometers, or it can have a thickness in a different range of thicknesses. When palladium is used, it can be plated at a rate of 0.6 plus or minus 0.1 ASD or other appropriate rate.

A fifth plating layer to act as an adhesion layer between the fourth plating layer and a top plate can be plated over the fourth plating layer. The fifth plating layer can be gold or other material such as copper, nickel, tin, tin copper, hard gold, or gold cobalt. The fifth plating layer can provide further leveling as well. The fifth plating layer can have a thickness of 0.02 to 0.05 micrometers, 0.05 to 0.15 micrometers, 0.10 to 0.20 micrometers, 0.15 to 0.30 micrometers, or more than 0.30 micrometers, or it can have a thickness in a different range of thicknesses.

A top plate can be formed over the fifth plating layer. The top plate can be highly corrosive and wear resistant. This layer can be thinned in high-stress locations to reduce the risk of cracking. The top plate can provide a durable contacting surface for when the contact on the electronic device housing the contact is mated with a corresponding contact on a second electronic device. In various embodiments of the present invention, the top plate can have a Vickers hardness below 100, between 100-200, between 200-300, over 300, or a hardness in another range. The top plate can be formed using rhodium-ruthenium, dark rhodium, dark ruthenium, gold copper, or other alternatives. The use of rhodium-ruthenium or rhodium can help oxygen formation, which can reduce its corrosion. The percentage of rhodium can be between 85 to 100 percent by weight, for example, it can be 95 or 99 percent by weight, where the most or all of the remaining material is ruthenium. This material can be chosen for its color, wear, hardness, conductivity, scratch resistance, or other property. The top plate can have a thickness less than 0.5 micrometers, between 0.5 and 0.75 micrometers, between 0.65 and 1.0 micrometers, between 0.75 and 1.0 micrometers, between 1.0 and 1.3 micrometers, more than 1.3 micrometers, or it can have a thickness in a different range of thicknesses.

In various embodiments of the present invention, these layers can be varied. For example, the top plate can be omitted over portions of the contact for various reasons. For example, where a contact has a surface-mount or through-hole contacting portion to be soldered to a corresponding contact on a printed circuit board, the top plate can be omitted from the surface-mount or through-hole contacting portion to improve solderability. In other embodiments of the present invention, other layers, such as the second and third plating layers, can be omitted.

In these and other embodiments of the present invention, one or more plating layers can be applied at a varying thickness along a length of the contact. In these embodiments, drum plating can be used. A contact on a carrier can be aligned with a window on an outside drum though which physical vapor deposition or other plating can occur. The window on the outside drum can have an aperture that is varied during rotation by an inside drum, the inside drum inside the outside drum.

These contacts can each have a high wear contacting portion to mate with a contact in a corresponding connector. They can have a low-stress beam portion, a high-stress beam portion, and a contacting portion, such as a surface-mount or through-hole contacting portion for mating with a corresponding contact on a printed circuit board or other appropriate substrate. A substrate for the contact can be stamped, for example from a sheet or strip of copper, or a strip that includes strips of copper welded to sides of a strip of a precious-metal alley. An electropolish or chemical polish step can be used to removing stamping burrs, though they can leave nodules or nodes on the contact surface.

Accordingly, a first plating layer to provide a surface leveling can be plated on the substrate. This first plating layer can be copper or other material such as gold, nickel, tin, tin copper, hard gold, or gold cobalt, or other material, and it can be plated over the contact substrate to level the surface of the stamped substrate. In these other embodiments of the present invention, the first plating layer can be sufficient and an electropolish step can be omitted. This first plating layer can also provide adhesion between its neighboring substrate and second plating layer. The first plating layer can have a thickness of 0.5 to 1.0 micrometers, 1.0 to 3.0 micrometers, 3.0 to 5.0 micrometers, or more than 5.0 micrometers, or it can have a thickness in a different range of thicknesses.

A second plating layer to provide corrosion resistance can be plated over first plating layer. The second plating layer can act as a barrier layer to prevent color leakage to the surface of the contact, and the material used for the second plating layer can be chosen on this basis. This second plating layer can be formed of palladium or other material such as nickel, tin-copper, or silver. The use of palladium or other material can provide a second plating layer that is more positively charged than a top plate of rhodium-ruthenium, rhodium, or other material. This can cause the top plate to act as a sacrificial layer, thereby protecting the underlying palladium. This layer can be somewhat harder than a third plating layer above it, which can prevent layers above the third plating layer from cracking when exposed to pressure during a connection. The second plating layer can have a thickness that varies along a length of the contact. For example, it can vary from of 0.1 to 0.2 micrometers, 0.2 to 0.3 micrometers, 0.3 to 0.5 micrometers, 0.3 to 1.5 micrometers, 1.0 to 1.5 micrometers or more than 1.5 micrometers, or it can have a thickness in a different range of thicknesses along a length of a contact. The second plating layer can be thicker near a high-wear contacting portion, and it can thin away from the high-wear region.

A third plating layer to act as an adhesion layer between the second plating layer and a top plate can be plated over the second plating layer. The third plating layer can be gold or other material such as copper, nickel, tin, tin copper, hard gold, or gold cobalt. The third plating layer can also provide a leveling effect. The third plating layer can have a thickness of 0.02 to 0.05 micrometers, 0.05 to 0.15 micrometers, 0.15 to 0.30 micrometers, or more than 0.30 micrometers, or it can have a thickness in a different range of thicknesses along a length of a contact.

A top plate can be formed over the third plating layer. The top plate can be highly corrosive and wear resistant. This top plate can be thinned in the high-stress beam portion to reduce the risk of cracking. The top plate can provide a durable contacting surface for when the contact on the electronic device housing the contact is mated with a corresponding contact on a second electronic device. In various embodiments of the present invention, the top plate can have a Vickers hardness below 100, between 100-200, between 200-300, over 300, or a hardness in another range. The top plate can be formed using rhodium-ruthenium, dark rhodium, dark ruthenium, gold copper, or other alternatives. The use of rhodium-ruthenium or rhodium can help oxygen formation, which can reduce its corrosion. The percentage of rhodium can be between 85 to 100 percent by weight, for example, it can be 95 or 99 percent by weight, where the most or all of the remaining material is ruthenium. This material can be chosen for its color, wear, hardness, conductivity, scratch resistance, or other property. The top plate can have a thickness less than 0.3 micrometers, between 0.3 and 0.55 micrometers, between 0.3 and 1.0 micrometers, between 0.75 and 1.0 micrometers, more than 1.0 micrometers, or it can have a thickness in a different range of thicknesses. Again, the top plate can be omitted from the surface-mount or through-hole contacting portion. The top plate can be thicker near a high-wear contacting portion, and it can thin away from the high-wear region.

In these and other embodiments of the present invention, other layers can be formed on contacts to prevent wear and corrosion. For example, a plastic insulating or nonconductive layer can be formed using electroplastic deposition or electro deposition (ED). This layer can cover portion of a contact to prevent corrosion. A contacting portion of the contact can remain exposed such that it can form an electrical connection with a contact in a corresponding connector. Also, a surface-mount or through-hole contact portion can remain exposed such that it can be soldered to a corresponding contact on a board or other appropriate substrate.

These and other embodiments of the present invention can provide a plating stack that is very hard and corrosion resistant, as well as wear resistant. Unfortunately, this hard plating stack can crack or create discontinuities when bent or stressed. This can be particularly problematic along portions of a flexible beam of a contact, which can bend when the contact is mated with a corresponding contact. As such, a contact with this hard plating stack can crack in its beam portion. These cracks can create a short corrosion path to an underlying substrate and other reactive layers in the hard plating stack, thereby accelerating corrosion of the contact.

Accordingly, embodiments of the present invention can provide this hard plating stack on a contacting portion of a contact and can reduce or limit the number of layers in the plating stack in a flexible beam area. Where a contact does not include a flexible beam portion, this hard plating stack can be used over a contacting portion and other portions of the contact.

In these and other embodiments of the present invention, a substrate formed of copper or copper alloy, niobium and its alloys, tantalum and its alloys, aluminum, aluminum alloy, stainless steel, rhodium, rhodium alloy, ruthenium, ruthenium alloy, rhodium-ruthenium, rhodium-iridium, other platinum group elements (palladium, osmium, iridium, and platinum) and their alloys, B540, B541, B563, B589, B683, B685, or B731, titanium, titanium alloy, gold, gold alloy, silver, silver alloy, other precious metal or its alloys, or other material, can be used for the contact. A leveling layer can be formed over the contact. This leveling layer can be formed of copper or other material and can have a thickness of 0.5 to 1.0 micrometers, 1.0 to 3.0 micrometers, 2.0 to 4.0 micrometers, or more than 4.0 micrometers, or it can have a thickness in a different range of thicknesses. A nickel-based support layer, such as a nickel, tin-nickel, nickel-tungsten, nickel phosphate, electroless nickel, nickel based metal, palladium-nickel, nickel-copper or other nickel based layer or other material, can be formed over the leveling layer. This nickel-based support layer can have a thickness of 0.5 to 1.0 micrometers, 1.0 to 3.0 micrometers, 3.0 to 5.0 micrometers, or more than 5.0 micrometers, or it can have a thickness in a different range of thicknesses. A first gold flash layer can be formed over the nickel-based support layer. This first gold flash can be exposed at a surface-mount or other portion of the contact where the contact is soldered to a board or other substrate. This first gold flash layer can have thickness of 0.02 to 0.05 micrometers, 0.05 to 0.15 micrometers, 0.15 to 0.30 micrometers, or more than 0.30 micrometers, or it can have a thickness in a different range of thicknesses along a length of a contact. For example, the first gold flash layer can be twice as thick (or flashed twice) in the beam area of a contact.

A first layer of a precious-metal alloy can next be formed on the contact. The first precious-metal alloy can be a rhodium alloy, such as rhodium-ruthenium. This layer can alternatively be formed of rhodium, ruthenium, a ruthenium alloy, rhodium-iridium, other Pt group elements (palladium, osmium, iridium, and platinum) and their alloys, B540, B541, B563, B589, B683, B685, or B731, titanium, titanium alloy, gold, gold alloy, silver, and silver alloy, other precious metal or its alloys. The first precious-metal-alloy layer can be plated over the contacting and beam portions of the contact. The first precious-metal-alloy layer (and subsequent layers described below) can be omitted over a surface-mount or other portion of the contact where the contact is soldered to a board or other substrate. In the contacting portion, the first precious-metal-alloy layer can have a thickness of 0.5 to 1.0 micrometers, 1.0 to 3.0 micrometers, 2.0 to 4.0 micrometers, or more than 4.0 micrometers, or it can have a thickness in a different range of thicknesses. The first precious-metal-alloy layer can have a thickness that tapers to a thinner dimension away from the contacting portion. For example, over the beam, the first precious-metal-alloy layer can have a thickness of 0.5 to 1.0 micrometers, 1.0 to 2.5 micrometers, 1.5 to 3.0 micrometers, or more than 3.0 micrometers, or it can have a thickness in a different range of thicknesses near the contacting portion, and it can have a thickness of 0.2 to 0.6 micrometers, 0.3 to 0.7 micrometers, 0.7 to 2.0 micrometers, or more than 2.0 micrometers, or it can have a thickness in a different range of thicknesses near the surface mount contacting portion.

The first gold flash layer can act as an adhesive for this first precious-metal-alloy layer in order to adhere the first precious metal alloy layer to the nickel-based support layer. A second gold flash layer can be formed over the first precious-metal-alloy layer on the contacting portion to allow adhesion of additional layers used to form the very hard plating stack over the contacting portion. This second gold flash layer and the additional layers may be omitted from a beam portion to reduce the hardness and increase the flexibility of the beam. Also, the first precious-metal-alloy layer and subsequent layers can be omitted from a surface-mount contacting portion of the contact to allow for soldering to a board or other substrate. This second gold flash layer can have thickness of 0.02 to 0.05 micrometers, 0.05 to 0.15 micrometers, 0.15 to 0.30 micrometers, or more than 0.30 micrometers, or it can have a thickness in a different range of thicknesses. A silver, palladium, or silver-palladium based layer can be formed over the second gold flash layer on the contact portion. This layer can be formed of silver and its alloys, palladium and its alloys, silver-palladium, a ternary silver-palladium-tellurium or quaternary silver-palladium-bismuth-tellurium, palladium-nickel, or other material. This layer can be a more reactive layer than subsequent layers formed on its surface. This more reactive layer can take the brunt of corrosive effects while protecting less reactive layers above and below it. To help ensure that this layer absorbs most of the corrosive effects, it can be formed having a number of micro-cracks or micro-pores in its structure. This silver or silver-palladium based layer can have thickness of 0.5 to 1.0 micrometers, 1.0 to 3.0 micrometers, 3.0 to 5.0 micrometers, or more than 5.0 micrometers, or it can have a thickness in a different range of thicknesses.

A second layer of precious-metal alloy can next be formed on the contacting portion. This second precious-metal alloy layer can be formed of the same material as the first layer of precious-metal alloy, or it can be formed of a different material. The second layer of precious-metal alloy can be formed of a rhodium alloy, such as rhodium-ruthenium. This layer can alternatively be formed of rhodium, ruthenium, ruthenium alloy, rhodium-iridium, other Pt group elements (palladium, osmium, iridium, and platinum) and their alloys, B540, B541, B563, B589, B683, B685, or B731, titanium, titanium alloy, gold, gold alloy, silver, and silver alloy, other precious metal or its alloys. The second precious-metal-alloy layer can form a top plate at the surface of the contacting portion. This second precious-metal-alloy layer can form a surface for the very hard plating stack on the contacting portion of the contact. This second precious-metal-alloy layer can have a thickness of 0.5 to 1.0 micrometers, 1.0 to 3.0 micrometers, 2.0 to 4.0 micrometers, or more than 4.0 micrometers, or it can have a thickness in a different range of thicknesses.

To avoid cracking of the plating layers at the beam portion of the contact, this very hard plating stack can be limited to the contacting portion of the contact. Since the beam portion of a contact does not directly form electrical connections, it can be protected with a ductile nonconductive protective layer. This layer can be a nonconductive electrophoretic coating formed of a base material containing impurities. The impurities can slow corrosion by increasing a total distance that corrosive elements must travel through the coating before reaching the plating stack under the electrophoretic coating. In these and other embodiments of the present invention, the base material can be acrylic resin, plastic, or other material. The impurities can be one of titanium dioxide, polytetrafluoroethylene, talcum, magnesium oxide, aluminum oxide, calcium oxide, or other inorganic particles. These particles can block corrosion paths through the nonconductive electrophoretic coating, thereby lengthening an effective corrosion path. This nonconductive electrophoretic coating can have a thickness of 2.0 to 5.0 micrometers, 3.0 to 10.0 micrometers, 5.0 to 15.0 micrometers, 10.0 to 20.0 micrometers, or more than 10.0 micrometers, or it can have a thickness in a different range of thicknesses. This electrophoretic coating can be formed in the same or similar manner as the other electrophoretic coatings described herein. As with the other examples disclosed herein, one or more of these layers, such as the second gold flash layer, can be omitted and one or more other layers can be added.

While embodiments of the present invention are well-suited to contact structures and their method of manufacturing, these and other embodiments of the present invention can be used to improve the corrosion resistance of other structures. For example, electronic device cases and enclosures, connector housings and shielding, battery terminals, magnetic elements, measurement and medical devices, sensors, fasteners, various portions of wearable computing devices such as clips and bands, bearings, gears, chains, tools, or portions of any of these, can be covered with a precious-metal alloy and plating layers as described herein and otherwise provided for by embodiments of the present invention. The precious-metal alloy and plating layers for these structures can be formed or manufactured as described herein and otherwise provided for by embodiments of the present invention. For example, magnets and other structures for fasteners, connectors, speakers, receiver magnets, receiver magnet assemblies, microphones, and other devices can have their corrosion resistance improved by structures and methods such as those shown herein and in other embodiments of the present invention.

In various embodiments of the present invention, the components of contacts and their connector assemblies can be formed in various ways of various materials. For example, contacts and other conductive portions can be formed by stamping, coining, metal-injection molding, machining, micro-machining, 3-D printing, or other manufacturing process. The conductive portions can be formed of stainless steel, steel, copper, copper titanium, phosphor bronze, palladium, palladium silver, or other material or combination of materials, as described herein. They can be plated or coated with nickel, gold, palladium, or other material, as described herein. The nonconductive portions, such as the housings and other portions, can be formed using injection or other molding, 3-D printing, machining, or other manufacturing process. The nonconductive portions can be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention can provide contacts and their connector assemblies that can be located in, or can connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contacts and their connector assemblies can provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
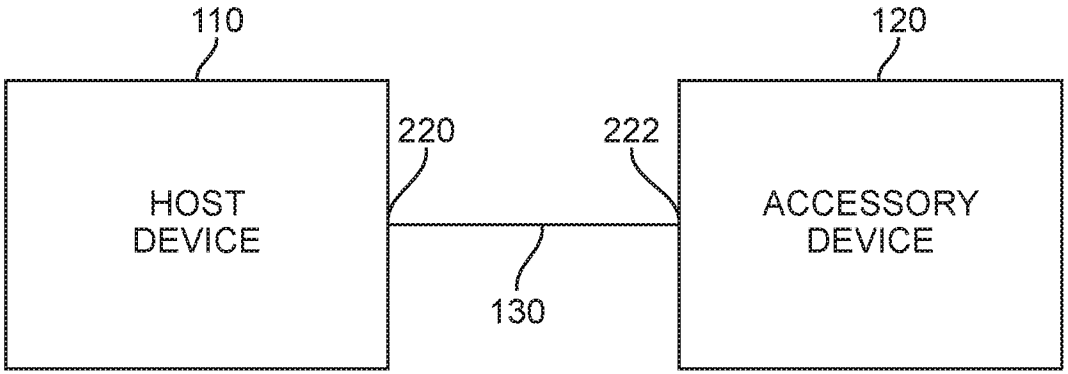
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, host device 110 can be connected to accessory device 120 in order to share data, power, or both. Specifically, contacts 220 on host device 110 can be electrically connected to contacts 222 on accessory device 120. Contacts 220 on host device 110 can be electrically connected to contacts 222 on accessory device 120 via cable 130. In other embodiments of the present invention, contacts 220 on host device 110 can be in physical contact and directly and electrically connected to contacts 222 on accessory device 120.

To facilitate a direction connection between contacts 220 on host device 110 and contacts 222 on accessory device 120, contacts 220 on host device 110 and contacts 222 on accessory device 120 can be located on the surfaces of their respective devices. But this location can make them vulnerable to exposure to liquids or other fluids. This exposure, particularly when there are voltages present on the exposed contacts, can lead to their corrosion. This corrosion can mar the contacts and can be readily apparent to a user. This corrosion can lead to a reduction in operation of the device and can even render the device inoperable. Even when such corrosion does not reach the level of device impairment, it can create a negative impression in the mind of a user that can reflect poorly on the device and the device's manufacturer.

Accordingly, embodiments of the present invention can provide contacts that can be highly corrosion resistant. But ordinarily, such an increase in corrosion resistance can lead to a reduction in manufacturability. Accordingly, embodiments of the present invention can provide contacts that are readily manufactured and can be manufactured using a limited amount of precious resources. Examples are shown in the following figures.

Figure 2:
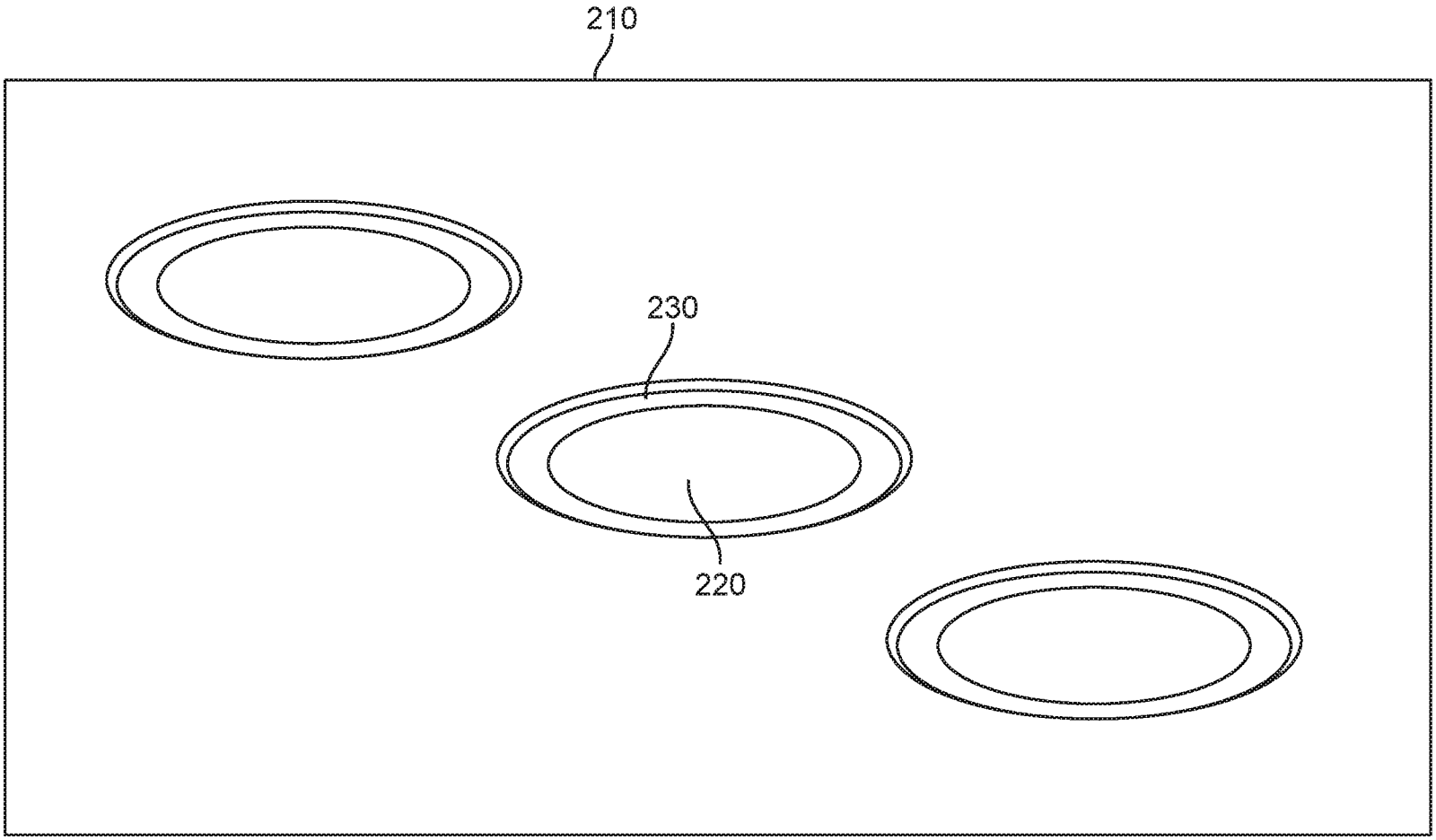
FIG. 2 illustrates a plurality of contacts according to an embodiment of the present invention at a surface of an electronic device.

FIG. 2 illustrates a plurality of contacts according to an embodiment of the present invention at a surface of an electronic device. In this example, contacts 220 are shown as being at a surface of a device enclosure 210. Contacts 220 can be insulated from device enclosure 210 by insulating rings of contact assembly housing 230. In other embodiments of the present invention, for example where device enclosure 210 is nonconductive, the insulation provided by contact assembly housing 230 might not be needed and contact assembly housing 230 can be omitted. In still other embodiments of the present invention, contacts 220 can be used in a connector insert (such as a connector insert shown herein), connector receptacle, or other connector structure.

In the following examples, contacts 220 are shown in greater detail. In these and the other embodiments of the present invention, contacts 222 on accessory device 120 can be the same as, substantially similar to, similar to, or different than contacts 220 on host device 110.

In various embodiments of the present invention, a surface of device enclosure 210 can have various shapes or contours. For example, device enclosure 210 can be flat, curved, or have other shapes. Surfaces of contacts 220 can be similarly contoured such that the surfaces of contacts 220 match the adjacent or local contours of device enclosure 210. In these and other embodiments of the present invention, device enclosure 210 portions can be similarly contoured to match the adjacent or local contours of contacts 220 and device enclosure 210. While three contacts of similar size are shown in this example, in other embodiments of the present invention, other numbers of contacts, such as two, four, or more than four contacts can be employed and one or more of these contacts can be of a different size.

Figure 3:
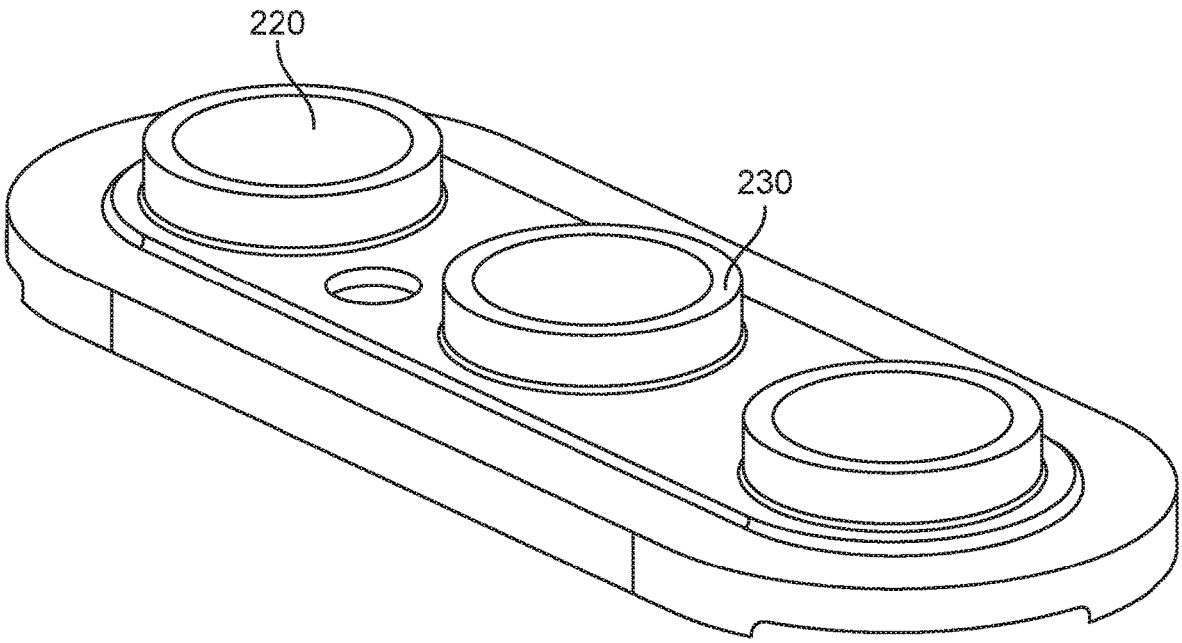
FIG. 3 illustrates a plurality of contacts in a contact assembly housing according to an embodiment of the present invention.

FIG. 3 illustrates a plurality of contacts in a contact assembly housing according to an embodiment of the present invention. In this example, contacts 220 can be located in a contact assembly housing 230. In various embodiments of the present invention, undersides of contacts 220 can mate with a flexible circuit board, printed circuit board, or other appropriate substrate.

Figure 4:
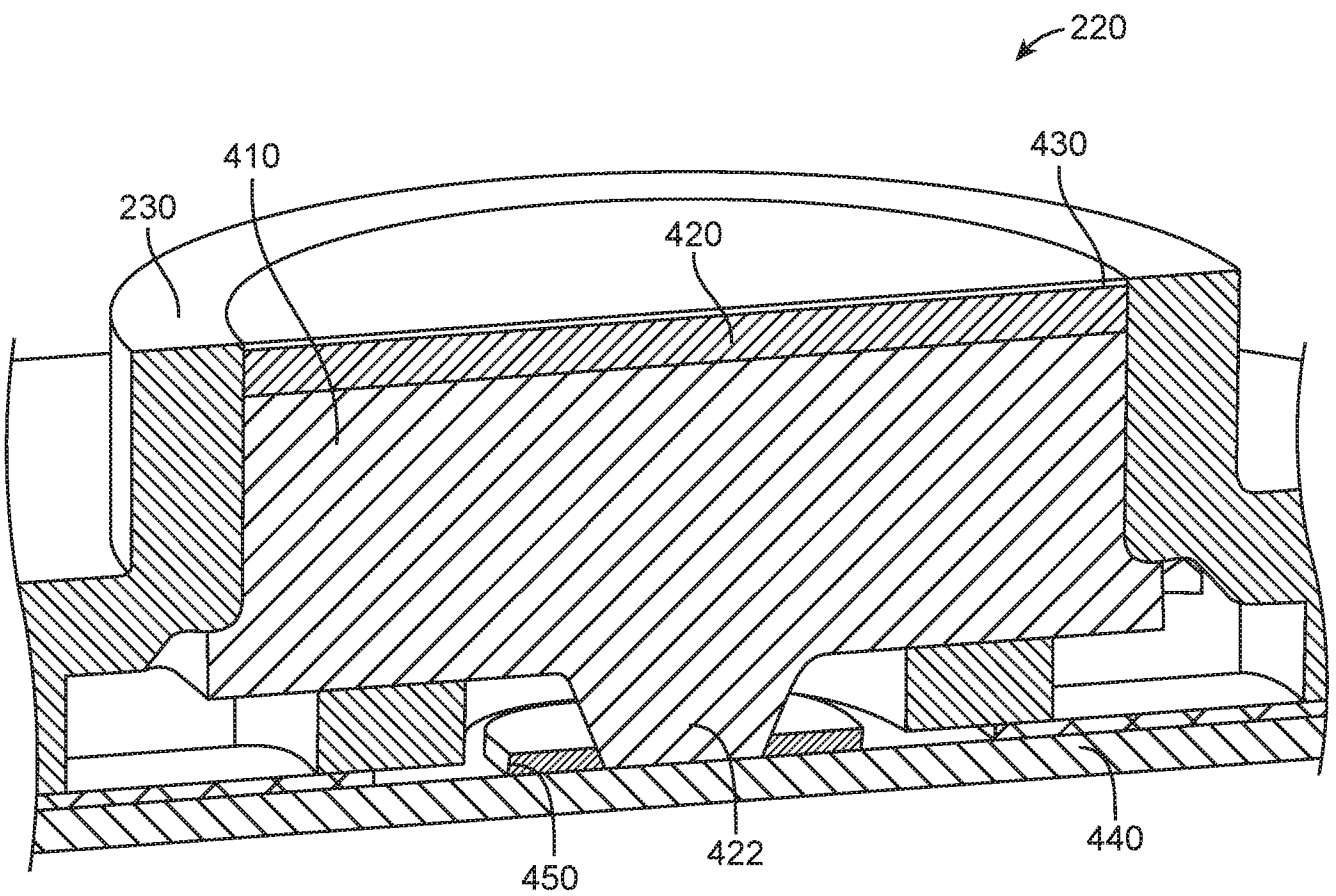
FIG. 4 illustrates a cross-section of a contact according to an embodiment of the present invention.

FIG. 4 illustrates a cross-section of a contact according to an embodiment of the present invention. As before, contact 220 is shown as being located in insulating rings of contact assembly housing 230. Contact 220 can include bulk or substrate layer 410. Contact 220 can have a primarily disk-shape, though contact 220 can have other shapes consistent with embodiments of the present invention. Bulk or substrate layer 410 can include narrow portion 422, which can be electrically connected by solder region 450 to board 440. Board 440 can be a flexible circuit board, printed circuit board, or other appropriate substrate. Board 440 can connect to electrical or mechanical, components in the electronic device housing contact 220. In this way, power and signals can be transferred between this electronic device and a second electronic device via contacts 220.

Contact 220 can include bulk or substrate layer 410. The resources consumed by contact 220 can be reduced by forming the bulk or substrate layer 410 using a more readily available material, such as copper or a material that is primarily copper based, such as phosphor bronze. In these and other embodiments of the present invention, the bulk or substrate layer 410 can be formed using copper-nickel-tin, copper-nickel-silver alloy, steel, or other appropriate material or alloy. Material having good electrical conductivity and a good availability can be selected for use to form the bulk or substrate layer 410. The material can also be selected to have a good formability or elongation and hardness similar to that of the material used for the precious-metal-alloy layer 420. In various embodiments of the present invention, the substrate layer can have a Vickers hardness below 100, between 100-200, between 200-300, over 300, or a hardness in another range. In these and other embodiments of the present invention, the bulk or substrate layer 410 can form the majority of the contact and can have a thickness less than 1 mm, more than 1 mm, between 0.5 mm and 1.5 mm, approximately 1.0 mm, between 1 mm to 10 mm, more than 10 mm, or it can have a thickness in a different range of thicknesses.

Bulk or substrate layer 410 can be clad by a precious-metal-alloy layer 420. Precious-metal-alloy layer 420 can be a high entropy material, such as materials consistent with ASTM Standards B540, B541, B563, B589, B683, B685, or B731, yellow gold, or other materials. The material for the precious-metal-alloy layer 420 can be selected to have a good hardness and strength, as well as a high conductivity or low electrical resistance. A material having a good formability or high elongation for improved manufacturability can be selected for use as the precious-metal alloy. In various embodiments of the present invention, the precious-metal-alloy layer 420 can have a Vickers hardness below 100, between 100-200, between 200-300, over 300, or a hardness in another range. In these and other embodiments of the present invention, the precious-metal-alloy layer 420 can have a thickness less than 10 micrometers, more than 10 micrometers, from 10 micrometers to 100 micrometers, from 10 micrometers to hundreds of micrometers, more than 100 micrometers, from 100 micrometers to hundreds of micrometers, or it can have a thickness in a different range of thicknesses.

In these and other embodiments of the present invention, one or more intermediate layers can be placed between the precious-metal-alloy layer 420 and the bulk or substrate layer 410. These intermediate layers can have better corrosion resistance than copper and can be more readily available than the material used as the precious-metal alloy. The one or more intermediate layers can be formed using titanium, steel, tantalum, or other material. This material can be selected based on its availability, formability, elongation, hardness, conductivity, ability to be stamped, or other property.

Cladding or precious-metal-alloy layer 420 can be plated by one or more plating layers, shown here as plating stack 430. Plating stacks, such as plating stack 430 can be used to provide a color match, or desired color mismatch, with a device enclosure 210 as shown in FIG. 1. Plating stacks, such as plating stack 430 can also be used to provide a hard, scratch resistant surface for contact 220. An example of such a plating stack is shown in the following figure.

Figure 5:
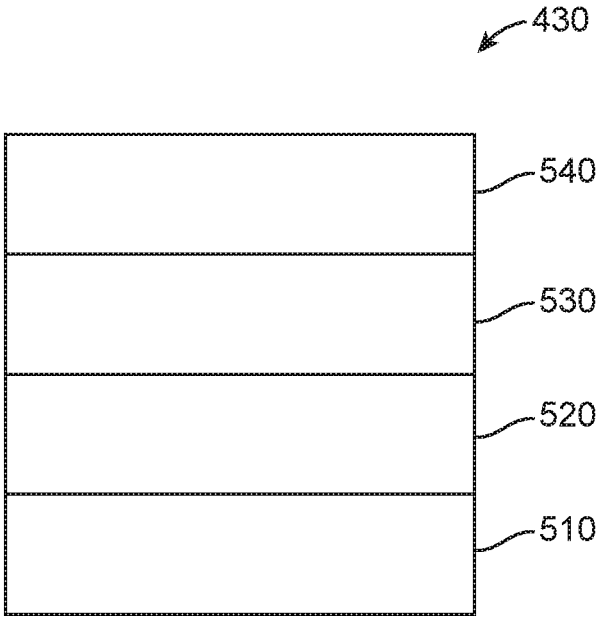
FIG. 5 illustrates a plating stack can be used to plate a contacting surface of a contact according to an embodiment of the present invention.

FIG. 5 illustrates a plating stack can be used to plate a contacting surface of a contact according to an embodiment of the present invention. This plating stack 430 can include a first plating layer 510 that can be plated over the precious-metal-alloy layer 420 as shown in FIG. 4 for leveling and adhesion. For example, gold can tend to fill vertical differences across a surface of the precious-metal-alloy layer 420. These vertical differences can include nodes and nodules that can be left behind by electropolishing and chemical polishing performed on the underlying material. First plating layer 510 can also provide adhesion between the precious-metal-alloy layer 420 and a second plating layer 520. Instead of gold, first plating layer 510 can be formed of nickel, copper, tin, tin copper, hard gold, gold cobalt, or other material. This first plating layer 510 can have a thickness less than 0.01 micrometers, between 0.01 and 0.05 micrometers, between 0.05 and 0.1 micrometers, between 0.05 and 0.15 micrometers, more than 0.1 micrometers, or it can have a thickness in a different range of thicknesses.

In these and other embodiments of the present invention, the first plating layer 510 can be omitted and the second plating layer 520 can be plated directly on the precious-metal layer.

In these and other embodiments of the present invention, a second plating layer 520 can be plated over first plating layer 510. Second plating layer 520 can act as a barrier layer to prevent color leakage from precious-metal-alloy layer 420 to the surface of contact 220, and the material used for second plating layer 520 can be chosen on this basis. In these and other embodiments of the present invention, second plating layer 520 can be formed using nickel, palladium, tin-copper, silver, or other appropriate material. The use of palladium or other material can provide a second plating layer 520 that is more positively charged than a top plate 540 of rhodium-ruthenium, rhodium, or other material. This can cause the top plate 540 to act as a sacrificial layer, thereby protecting the underlying palladium in second plating layer 520. This second plating layer 520 can be somewhat harder than a third plating layer 530 above it, which can prevent layers above the third plating layer 530 from cracking when exposed to pressure during a connection. This second plating layer 520 can have a thickness less than 0.1 micrometers, between 0.1 and 0.5 micrometers, between 0.5 and 1.0 micrometers, between 1.0 and 1.5 micrometers, more than 1.0 micrometers, or it can have a thickness in a different range of thicknesses.

In these and other embodiments of the present invention, a third plating layer 530 can be plated over second plating layer 520. Third plating layer 530 may, like first plating layer 510, provide leveling and adhesion. For example, gold can tend to fill vertical differences across a surface of the second plating layer, the barrier layer, and can provide adhesion between second plating layer 520 and a top plate 540. Instead of gold, third plating layer 530 can be formed of nickel, palladium, copper, tin, tin copper, hard gold, gold cobalt, or other material. This third plating layer 530 can have a thickness less than 0.01 micrometers, between 0.01 and 0.05 micrometers, between 0.05 and 0.1 micrometers, between 0.05 and 0.15 micrometers, more than 0.1 micrometers, or it can have a thickness in a different range of thicknesses.

In these and other embodiments of the present invention, top plate 540 can be plated over third plating layer 530. Top plate 540 can provide a durable contacting surface for when contact 220 on the electronic device housing the contact is mated with a corresponding contact on a second electronic device. In various embodiments of the present invention, top plate 540 can have a Vickers hardness below 100, between 100-200, between 200-300, over 300, or a hardness in another range. Top plate 540 can be formed using rhodium-ruthenium, dark rhodium, dark ruthenium, gold copper, or other alternatives. This material can be chosen for its color, wear, hardness, conductivity, scratch resistance, or other property. The use of rhodium-ruthenium or rhodium can help oxygen formation, which can reduce the corrosion of top plate 540. The percentage of rhodium can be between 85 to 100 percent by weight, for example, it can be 95 or 99 percent by weight, where the most or all of the remaining material is ruthenium. Top plate 540 can have a thickness less than 0.5 micrometers, between 0.5 and 0.75 micrometers, between 0.75 and 0.85 micrometers, between 0.85 and 1.1 micrometers, more than 1.1 micrometers, or it can have a thickness in a different range of thicknesses.

In these and other embodiments of the present invention, third plating layer 530 can be omitted and top plate 540 can be plated directly on second plating layer 520.

In these and other embodiments of the present invention, top plate 540 can be plated directly over first plating layer 510 and second plating layer 520 and third plating layer 530 can be omitted.

In these and other embodiments of the present invention, the plating materials used can be selected based on availability, formability, elongation, hardness, conductivity, ability to be stamped, or other property. These and the other contacts shown herein and consistent with embodiments of the present invention can be formed in various ways. An example is shown in the following figure.

Figure 6:
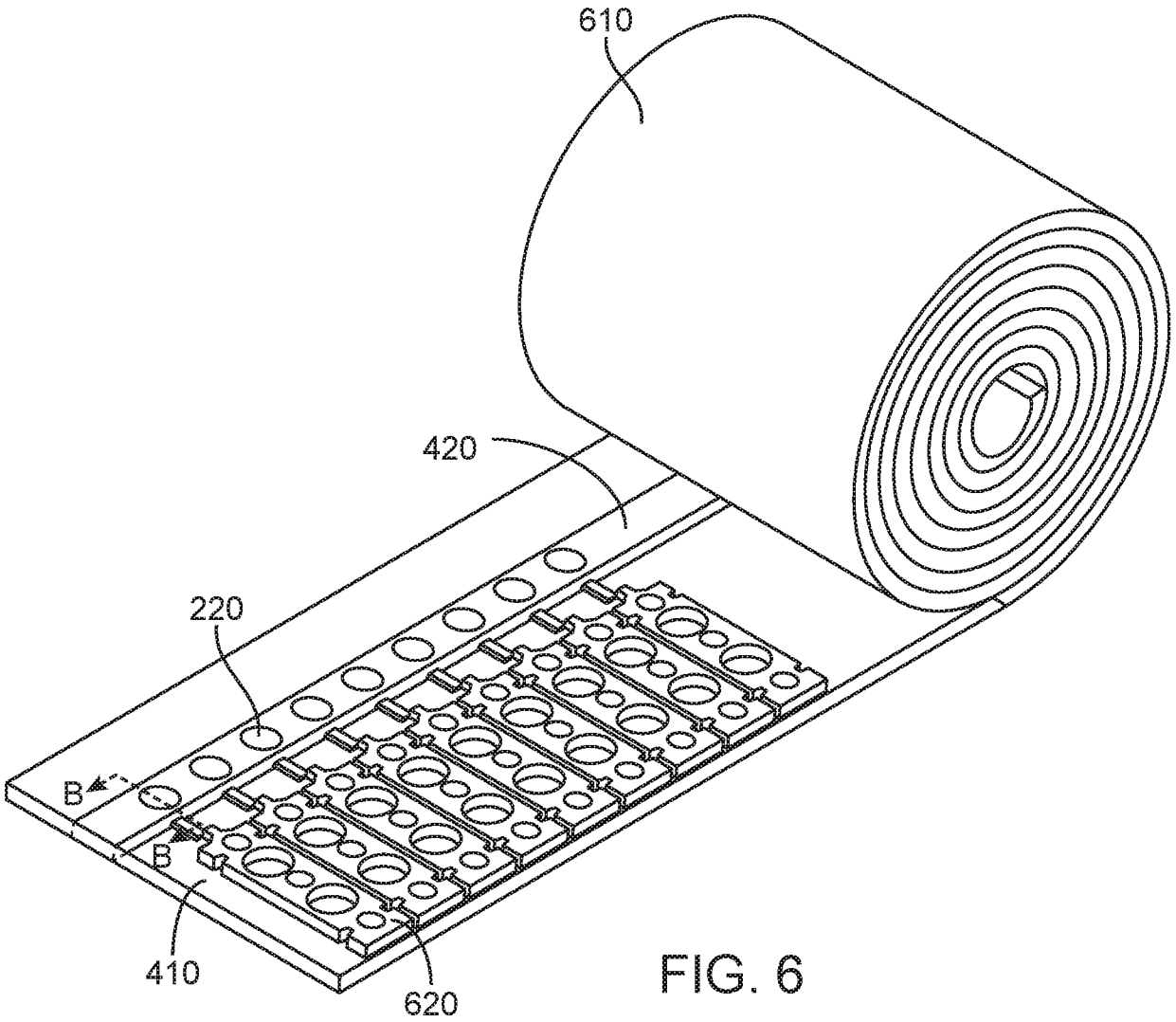
FIG. 6 illustrates a method of manufacturing contacts according to an embodiment of the present invention.

FIG. 6 illustrates a method of manufacturing contacts according to an embodiment of the present invention. This and similar methods can be used to manufacture the above and other contacts shown herein, as well as other contacts according to embodiments of the present invention. In this example, a bulk or substrate layer 410 can be at least partially covered by a layer of precious-metal-alloy layer 420. These layers can be provided in rolls 610. Rolls 610 can be stamped or coined to form contacts 220. Carriers 620, attached to contacts 220, can similarly be stamped. Carriers 620 can be used to manipulate contacts 220 during later processing steps such as blasting, polishing, etching, annealing, or other processing steps. Contacts 220 can be stamped in a manner to efficiently utilize the precious-metal-alloy layer 420. Unused material from precious-metal layers, such as precious-metal-alloy layer 420, and bulk or substrates, such as bulk or substrate layer 410, can be recycled or otherwise reused.

It can be very difficult to plate bulk or substrate layer 410 with a precious-metal-alloy layer 420. Accordingly, in this embodiment of the present invention, contacts 220 can be stamped from bulk or substrate layer 410 and precious-metal-alloy layer 420. This stamping process can be coining or other type of process. This stamping process can bond the precious-metal-alloy layer 420 to the bulk or substrate layer 410. This stamping process can be done at an elevated temperature (which can be used for annealing.) The material of roll 610 can be stretched or elongated during stamping or coining in order to bond the precious-metal-alloy layer 420 and bulk or substrate layer 410. For example, a 35, 50, or 70 percent elongation can be used.

In these and other embodiments of the present invention this diffusion or bonding layer can be formed when the precious-metal alloy is bonded or clad to the substrate. This bonding layer can be an intermetallic bond of the precious-metal-alloy layer 420 and the alloy of the bulk or substrate layer 410. This diffusion or bonding layer can be less than 1 micrometer, more than 1 micrometer, 1 to 5 micrometers, 5 micrometers, or more than 5 micrometers thick.

This and similar processes can be used to form contacts described herein and in other embodiments of the present invention. An example of a stamped contact is shown in the following figure.

Figure 7:
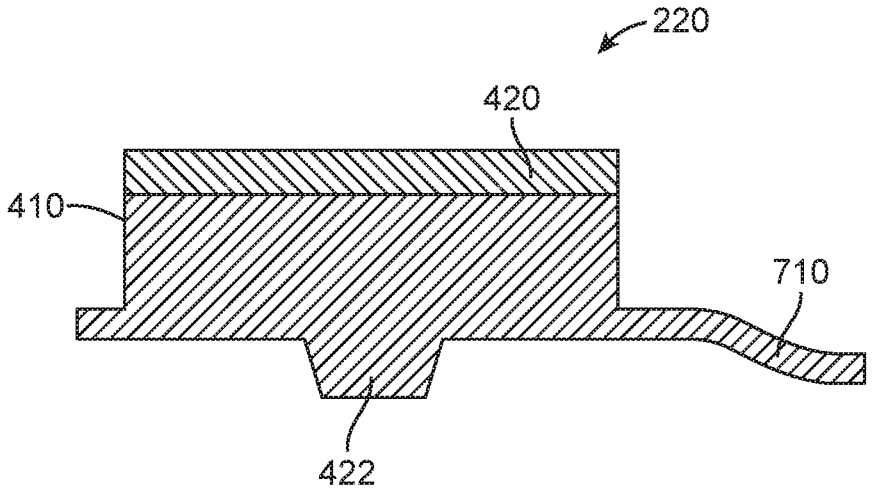
FIG. 7 illustrates a side view of a stamped or coined contact according to an embodiment of the present invention.

FIG. 7 illustrates a side view of a stamped or coined contact according to an embodiment of the present invention. Contact 220 can include a bulk or substrate layer 410 having a narrow portion 422. Narrow portion 422 can be soldered to a flexible circuit board, printed circuit board, or other appropriate substrate. Bulk or substrate layer 410 can be clad with a precious-metal-alloy layer 420. Tail portion 710 can remain after carrier 620 has been broken away or otherwise physically disconnected from contact 220. After stamping, contact 220 can be blasted, annealed, polished, plated, or subjected to other processing steps, as shown herein.

In the above examples, contacts 220 are shown as contacts at a surface of a device enclosure 210. In other embodiments of the present invention, the same or similar structures, layers, manufacturing, and processing steps can be used to form contacts for a connector insert or a connector receptacle, for example a connector receptacle where contacts are located in an opening in a device enclosure. Examples of such contacts that can be used in a connector insert or connector receptacle are shown in the following figures. These and other embodiments of the present invention can be used as contacts on a surface of a device or elsewhere as shown above as well.

Figure 8:
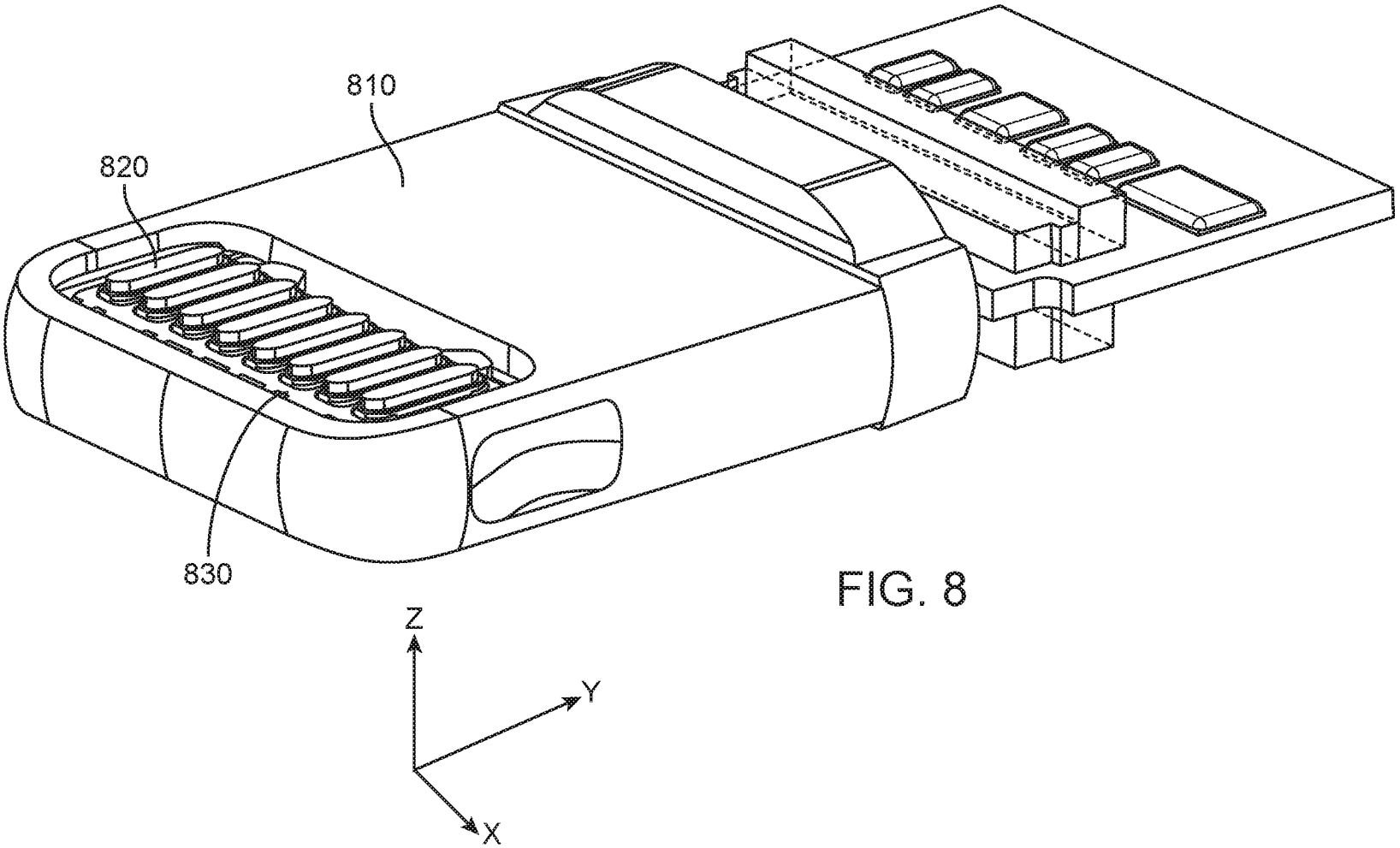
FIG. 8 illustrates a connector insert that can be improved by the incorporation of an embodiment of the present invention.

FIG. 8 illustrates a connector insert that can be improved by the incorporation of an embodiment of the present invention. In this example, a connector insert can include a ground ring 810 surrounding an opening 830 for contacts 820. Contacts 820 can have a length along a major axis in the Y direction that is longer than a length along a minor axis in the X direction. Typically, opening 830 can be filled with an overmold such that only surfaces of contacts 820 are exposed. While contacts 820 are shown here as being located in a connector insert, in other embodiments of the present invention, contacts 820, and the other contacts shown herein and those consistent with embodiments of the present invention can be located at a surface of a device enclosure, in a connector receptacle, or in another type of contacting structure.

Figure 9:
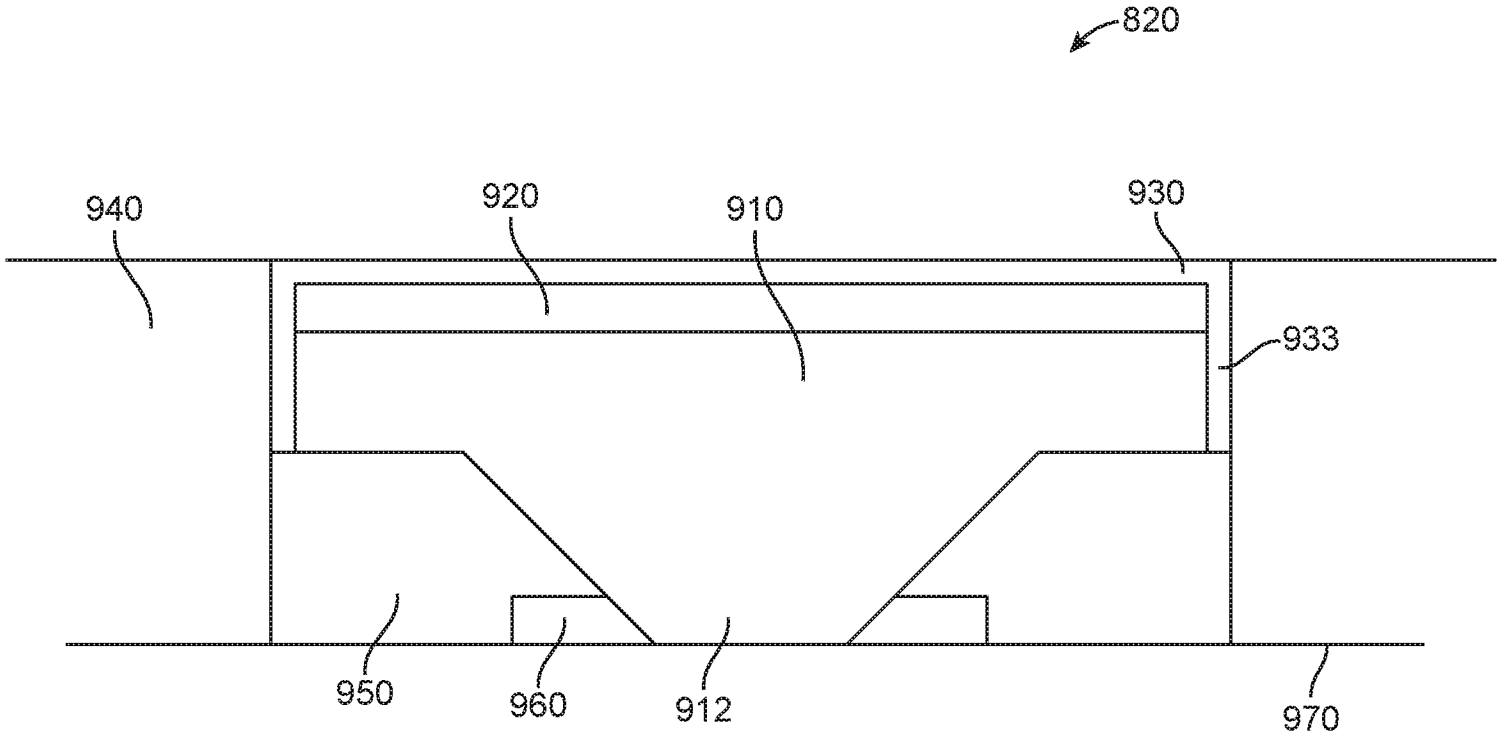
FIG. 9 illustrates a side view of a contact according to an embodiment of the present invention.

FIG. 9 illustrates a side view of a contact according to an embodiment of the present invention. Contact 820 can include a bulk or substrate layer 910. Bulk or substrate layer 910 can terminate in a narrow portion 912. Narrow portion 912 can be electrically connected through solder 960 to a contact on board 970, which can be a flexible circuit board, printed circuit board, or other appropriate substrate. Areas 950 below portions of bulk or substrate layer 910 can include air gaps to reduce side-to-side capacitance between contacts 820. Board 970 can connect to conductors or electrical or mechanical, components in the connector insert housing contact 820. In this way, power and signals can be transferred between a first electronic device and a second electronic device via contacts 820.

Bulk or substrate layer 910 can be clad by precious-metal-alloy layer 920. Precious-metal-alloy layer 920 can be plated by plating stack 930. Plating stack 930 can extend along sides of the contact shown as regions 933. Regions 933 can be omitted or can extend along other portions of the underside of contact 820. Contact 820 can be located in an overmold region 940 in opening 830 in ground ring 810 as shown in FIG. 8.

The resources consumed by contact 820 can be reduced by forming the bulk or substrate layer 910 using a readily available material, such as copper or a material that is primarily copper based, such as phosphor bronze. In these and other embodiments of the present invention, the bulk or substrate layer 910 can be formed using copper-nickel-tin, copper-nickel-silver alloy, steel, or other appropriate material or alloy. Material having good electrical conductivity and a good availability can be selected for use to form bulk or substrate layer 910. The material can also be selected to have a good formability and elongation and hardness similar to that of the material used for the precious-metal-alloy layer 920. In various embodiments of the present invention, the bulk or substrate layer 910 can have a Vickers hardness of below 100, between 100-200, between 200-300, over 300, or a hardness in another range. In these and other embodiments of the present invention, the bulk or substrate layer 910 can form the majority of the contact and can have a thickness less than 1 mm, more than 1 mm, from 0.5 to 1.5 mm, approximately 1.0 mm, between 1 mm and 10 mm, more than 10 mm, or it can have a thickness in a different range of thicknesses.

Bulk or substrate layer 910 can be clad by a precious-metal-alloy layer 920. Precious-metal-alloy layer 920 can be a high entropy material, such as materials consistent with ASTM Standards B540, B541, B563, B589, B683, B685, or B731, yellow gold, or other materials. The material for the precious-metal-alloy layer 920 can be selected to have a good hardness and strength, as well as a high conductivity or low electrical resistance. A material having a good formability and high elongation for improved manufacturability can be selected for use as the precious-metal alloy. In various embodiments of the present invention, the precious-metal-alloy layer 920 can have a Vickers hardness below 100, between 100-200, between 200-300, over 300, or a hardness in another range. In these and other embodiments of the present invention, the precious-metal-alloy layer 920 can have a thickness less than 10 micrometers, more than 10 micrometers, from 10 micrometers to 100 micrometers, from 10 micrometers to hundreds of micrometers, more than 100 micrometers, from 100 micrometers to hundreds of micrometers, or it can have a thickness in a different range of thicknesses.

In these and other embodiments of the present invention, one or more intermediate layers can be placed between precious-metal-alloy layer 920 and the bulk or substrate layer 910. These intermediate layers can have better corrosion resistance than copper and can also be more readily available than the material used as the precious-metal alloy. The one or more intermediate layers can be formed using titanium, steel, tantalum, or other material. This material can be selected based on its availability, formability, elongation, hardness, conductivity, ability to be stamped, or other property.

Cladding or precious-metal-alloy layer 920 can be plated by one or more plating layers, shown here as plating stack 930. Plating stack 930 can be used to provide a color match, or desired color mismatch, with ground ring 810 as shown in FIG. 8. Plating stack 930 can also be used to provide a hard, scratch resistant surface for contact 820. An example of such a plating stack is shown in the following figure.

Figure 10:
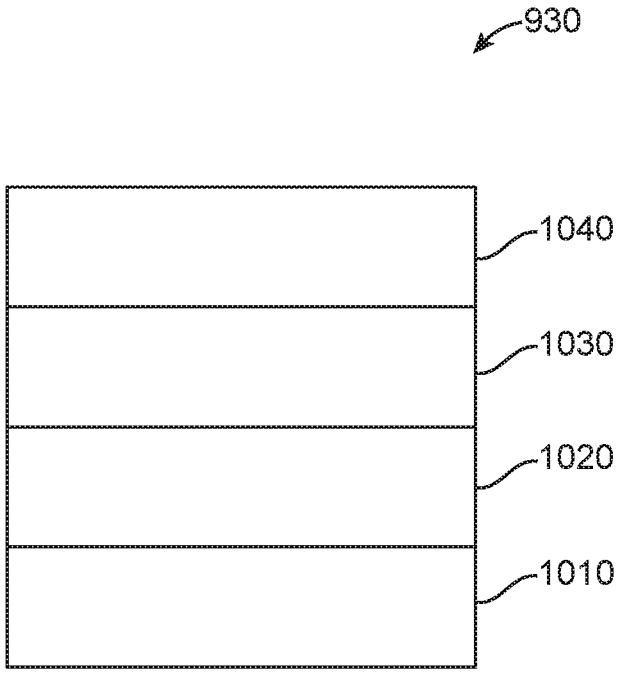
FIG. 10 illustrates a plating stack that can be used to plate a contacting surface of a contact according to embodiments of the present invention.

FIG. 10 illustrates a plating stack that can be used to plate a contacting surface of a contact according to embodiments of the present invention. This plating stack 930 can include a first plating layer 1010 that can be plated over the precious-metal-alloy layer 920 as shown in FIG. 9 for leveling and adhesion. For example, gold can tend to fill vertical differences across a surface of the precious-metal-alloy layer 920. These vertical differences can include nodes and nodules that can be left behind by electropolishing and chemical polishing performed on the underlying material. First plating layer 1010 can also provide adhesion between the precious-metal-alloy layer 920 and a second plating layer 1020. Instead of gold, the first plating layer 1010 can be formed of nickel, copper, tin, tin copper, hard gold, gold cobalt, or other material. This first plating layer 1010 can have a thickness less than 0.01 micrometers, between 0.01 and 0.05 micrometers, between 0.05 and 0.1 micrometers, between 0.05 and 0.15 micrometers, more than 0.1 micrometers, or it can have a thickness in a different range of thicknesses.

In these and other embodiments of the present invention, a second plating layer 1020 can be plated over first plating layer 1010. Second plating layer 1020 can act as a barrier layer to prevent color leakage from the precious-metal-alloy layer 920 to the surface of the contact, and the material used can be chosen on that basis. In these and other embodiments of the present invention, the second plating layer 1020 can be formed using nickel, palladium, tin-copper, silver, or other appropriate material. The use of palladium or other material can provide a second plating layer 1020 that is more positively charged than a top plate 1040 of rhodium-ruthenium, rhodium, or other material. This can cause the top plate 1040 to act as a sacrificial layer, thereby protecting the underlying palladium in second plating layer 1020. This second plating layer 1020 can be somewhat harder than a third plating layer 1030 above it, which can prevent layers above the third plating layer 1030 from cracking when exposed to pressure during a connection. This second plating layer 1020 can have a thickness less than 0.1 micrometers, between 0.1 and 0.5 micrometers, between 0.5 and 1.0 micrometers, between 1.0 and 1.5 micrometers, more than 1.0 micrometers, or it can have a thickness in a different range of thicknesses.

In these and other embodiments of the present invention, first plating layer 1010 can be omitted and second plating layer 1020 can be plated directly on precious-metal-alloy layer 920.

In these and other embodiments of the present invention, a third plating layer 1030 can be plated over second plating layer 1020. Third plating layer 1030 may, like first plating layer 1010, can provide leveling and adhesion. For example, gold can tend to fill vertical differences across a surface of the second plating layer, the barrier layer, and can provide adhesion between second plating layer 1020 and a top plate 1040. Instead of gold, third plating layer 1030 can be formed of nickel, copper, tin, tin copper, hard gold, gold cobalt, or other material. This third plating layer 1030 can have a thickness less than 0.01 micrometers, between 0.01 and 0.05 micrometers, between 0.05 and 0.1 micrometers, between 0.05 and 0.15 micrometers, more than 0.1 micrometers, or it can have a thickness in a different range of thicknesses.

In these and other embodiments of the present invention, top plate 1040 can be plated over third plating layer 1030. Top plate 1040 can provide a durable contacting surface for when contact 820 on the electronic device housing the contact is mated with a corresponding contact on a second electronic device. Top plate 1040 can be formed using rhodium-ruthenium, dark rhodium, dark ruthenium, gold copper, or other alternatives. This material can be chosen for its color, wear, hardness, conductivity, scratch resistance, or other property. The use of rhodium-ruthenium or rhodium can help oxygen formation, which can reduce the corrosion of top plate 540. The percentage of rhodium can be between 85 to 100 percent by weight, for example, it can be 95 or 99 percent by weight, where the most or all of the remaining material is ruthenium. In various embodiments of the present invention, top plate 1040 can have a Vickers hardness below 100, between 100-200, between 200-300, over 300, or a hardness in another range. Top plate 1040 can have a thickness less than 0.5 micrometers, between 0.5 and 0.75 micrometers, between 0.75 and 0.85 micrometers, between 0.85 and 1.1 micrometers, more than 1.1 micrometers, or it can have a thickness in a different range of thicknesses.

In these and other embodiments of the present invention, third plating layer 1030 can be omitted and top plate 1040 can be plated directly on second plating layer 1020.

In these and other embodiments of the present invention, top plate 1040 can be plated directly over first plating layer 1010 and either or both plating layers 1020 and 1030 can be omitted.

In these and other embodiments of the present invention, the plating materials used can be selected based on availability, formability, elongation, hardness, conductivity, ability to be stamped, or other property.

These and the other contacts shown herein and consistent with embodiments of the present invention can be formed in various ways. An example is shown in the following figure.

Figure 11:
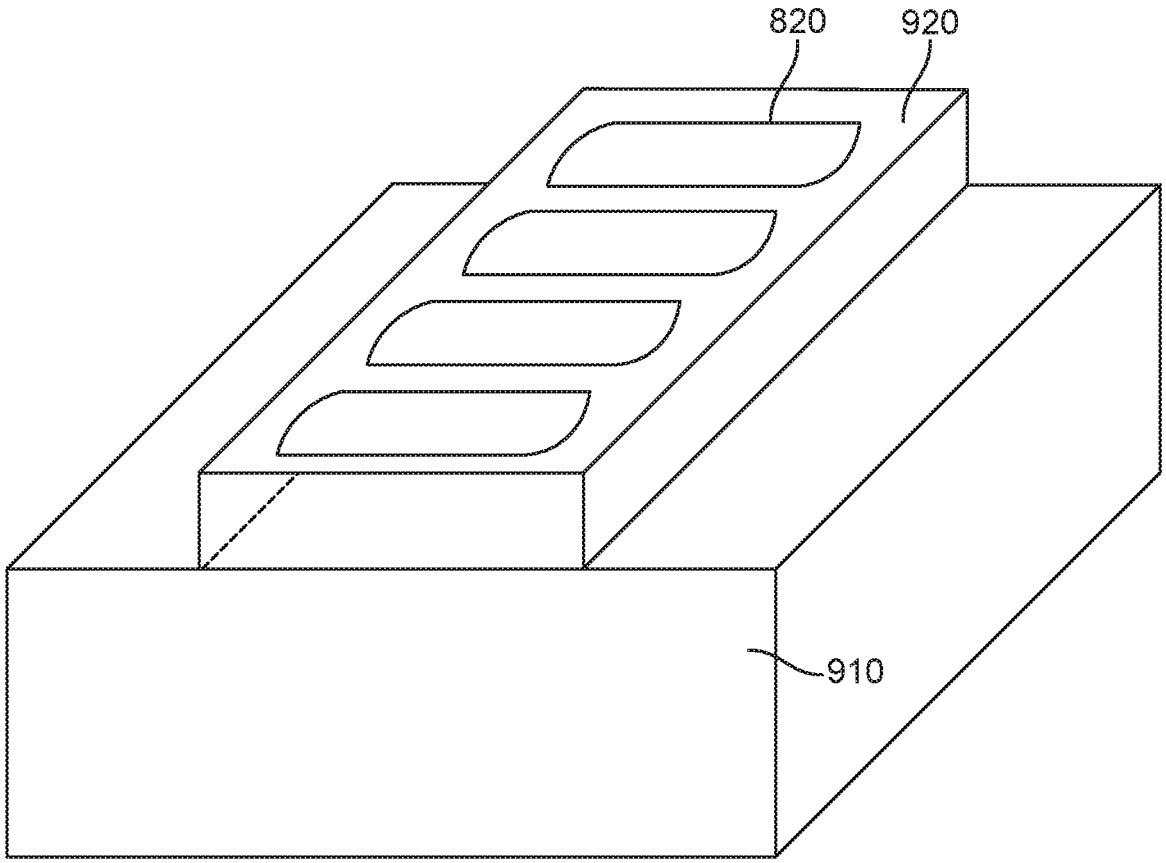
FIG. 11 illustrates a method of manufacturing contacts according to an embodiment of the present invention.

FIG. 11 illustrates a method of manufacturing contacts according to an embodiment of the present invention. This and similar methods can be used to manufacture the above and other contacts shown herein, as well as other contacts according to embodiments of the present invention.

In this example, bulk or substrate layer 910 can be at least partially covered by a precious-metal-alloy layer 920. These layers can be provided on a roll, as shown as roll 610 in FIG. 6. Contacts 820 can be stamped, coined, or otherwise formed in these layers. Carriers (not shown) can be stamped at the same time and used to handle contacts 820 during further processing steps.

In other embodiments of the present invention, precious-metal-alloy layer 920 can be embedded in bulk or substrate layer 910. An example is shown in the following figure.

Figure 12:
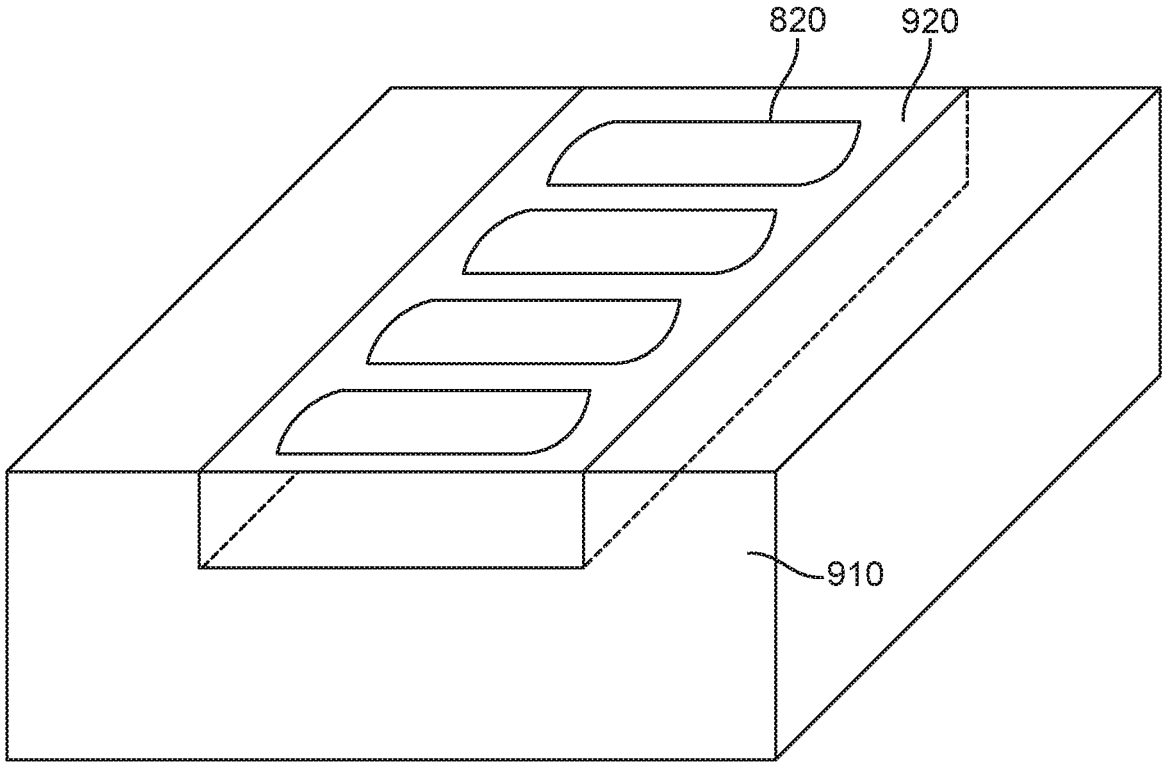
FIG. 12 illustrates a method of manufacturing contacts according to an embodiment of the present invention.

FIG. 12 illustrates a method of manufacturing contacts according to an embodiment of the present invention. In this example, a groove has been skived, cut, etched, or otherwise formed in a surface of bulk or substrate layer 910. A precious-metal-alloy layer 920 has been placed or formed in this groove. As before, contacts 820 can be stamped or coined. Carriers (not shown) can be stamped at the same time and used to handle contacts 820 during further processing steps.

Figure 13:
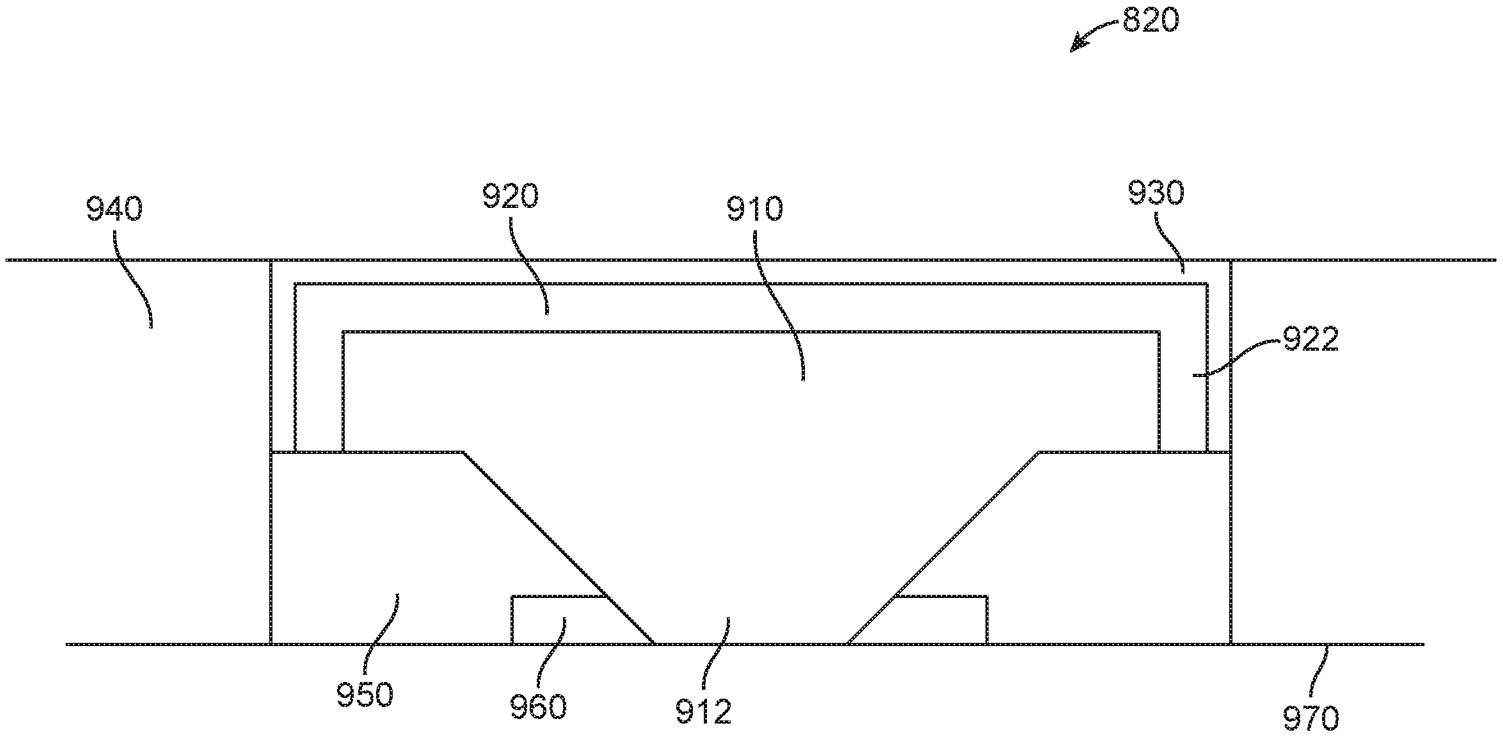
FIG. 13 illustrates another contact according to an embodiment of the present invention.

FIG. 13 illustrates another contact according to an embodiment of the present invention. In this example, some or all of the layers and structures can be identical to the contact shown in FIG. 9. Precious-metal-alloy layer 920 can extend along sides of bulk or substrate layer 910. This can further help to reduce corrosion. Specifically, if moisture or liquid seeps between 940 and contact 820, sides of bulk or substrate layer 910 can be exposed to corrosion.

This corrosion can be reduced by the presence of side portions 922 of precious-metal-alloy layer 920. Side portions 922 can be formed at tips or ends of contacts 820, for example, at ends of the major axis of contacts 820. In other examples, the side portions 922 of precious-metal-alloy layer 920 can be around all or portions of sides of bulk or substrate layer 910.

Side portions 922 of precious-metal-alloy layer 920 can be formed in various ways. Examples are shown in the following figures.

Figure 14:
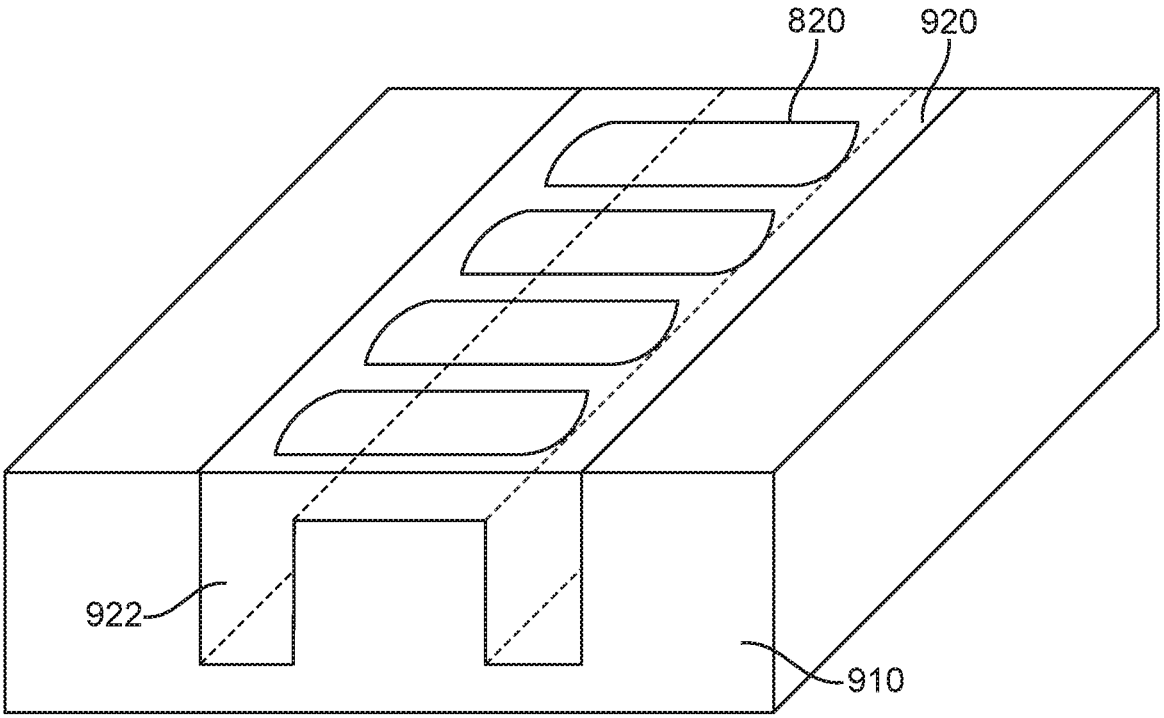
FIG. 14 illustrates a method of manufacturing contacts according to an embodiment of the present invention.

FIG. 14 illustrates a method of manufacturing contacts according to an embodiment of the present invention. In this example, one or more grooves have been formed in bulk or substrate layer 910. That is, one or more grooves have been skived, cut, etched, or otherwise formed in a surface of bulk or substrate layer 910. These one or more grooves have been filled in with precious-metal-alloy layer 920. Two grooves have a greater depth can be used to form side portions 922. Contacts 820 and carriers can be stamped or coined as described herein.

The one or more grooves in bulk or substrate layer 910 can be formed in various ways. Examples are shown in the following figures.

Figure 15:
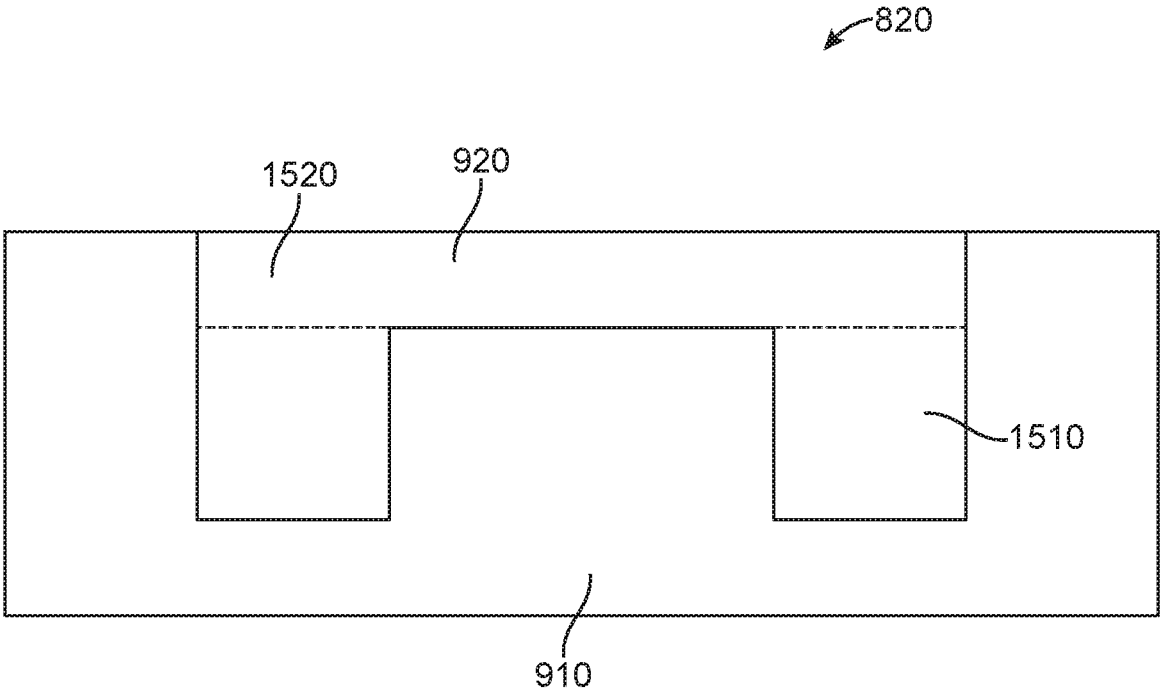
FIG. 15 illustrates a method of forming layers for contacts according to an embodiment of the present invention.

FIG. 15 illustrates a method of forming layers for contacts according to an embodiment of the present invention. In this example, groove 1520 can be formed in bulk or substrate layer 910. This groove can be formed by skiving, cutting, etching, or other appropriate method. Deeper grooves 1510 can then be formed in bulk or substrate layer 910 by skiving, cutting, etching, or other process step. The resulting grooves can be filled with precious-metal-alloy layer 920.

Figure 16:
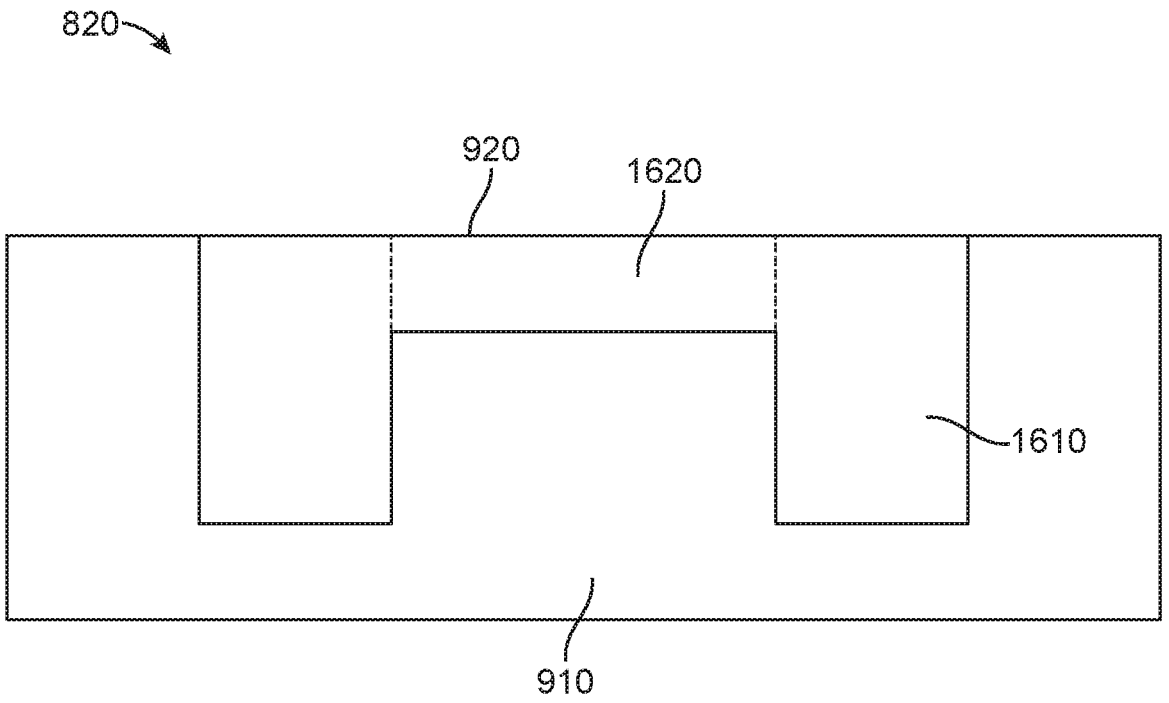
FIG. 16 illustrates another method of forming layers for contacts according to an embodiment of the present invention.

FIG. 16 illustrates another method of forming layers for contacts according to an embodiment of the present invention. In this example, grooves 1610 can be initially formed by skiving, cutting, etching, or other process in bulk or substrate layer 910. Groove 1620 can then be formed, again by skiving, cutting, edging, or other process step. Cladding or precious-metal-alloy layer 920 can then be used to fill the opening formed by grooves 1610 and 1620.

Figure 17:
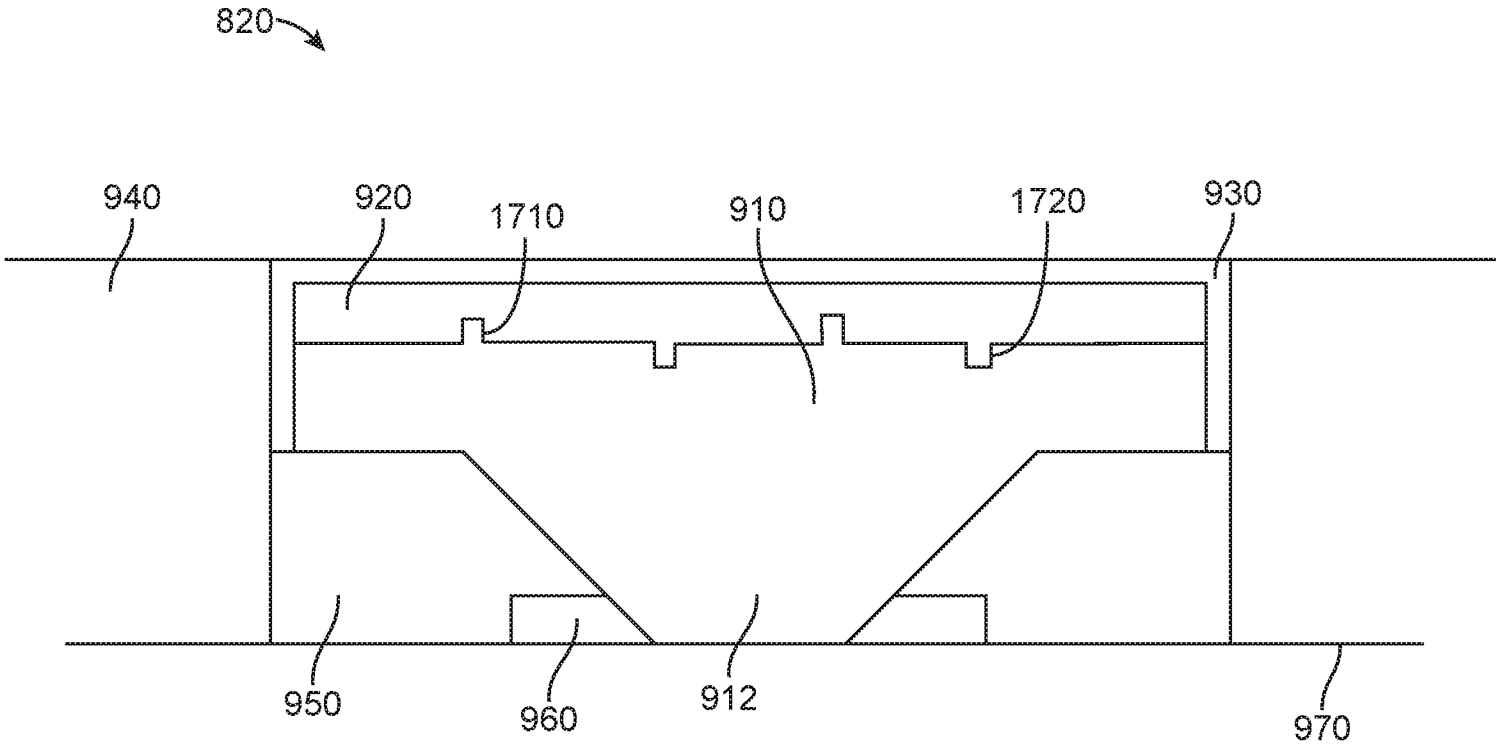
FIG. 17 illustrates another contact according to an embodiment of the present invention.

FIG. 17 illustrates another contact according to an embodiment of the present invention. In this example, some or all of the layers and structures can be identical or similar to the contact shown in FIG. 9. In this example, either or both bulk or substrate layer 910 and precious-metal-alloy layer 920 can include tabs and notches 1710 and 1720. These tabs and notches 1710 and 1720 can be used to secure bulk or substrate layer 910 to precious-metal-alloy layer 920, for example in conjunction with laser welding. In various embodiments of the present invention, either of these tabs can be long enough to pass through the adjacent layer and be riveted or laser welded on the other side to secure bulk or substrate layer 910 to precious-metal-alloy layer 920.

In these and other embodiments of the present invention, contacts can be formed in other ways and have different plating layers. For example, strips of a copper alloy or other material can be butt-welded or otherwise fixed or attached to sides of a strip of a precious-metal alloy to form a strip or roll of material for stamping. Contacts can be stamped such that all of the contact is formed of the precious-metal alloy while a carrier is formed of the copper alloy or other material. Contacts can also be stamped such that only portions, such as a contacting portion, are formed of the precious-metal alloy while the remainder of the contact and a carrier is formed of the copper alloy or other material in order to conserve resources. Examples are shown in the following figures.

Figure 18:
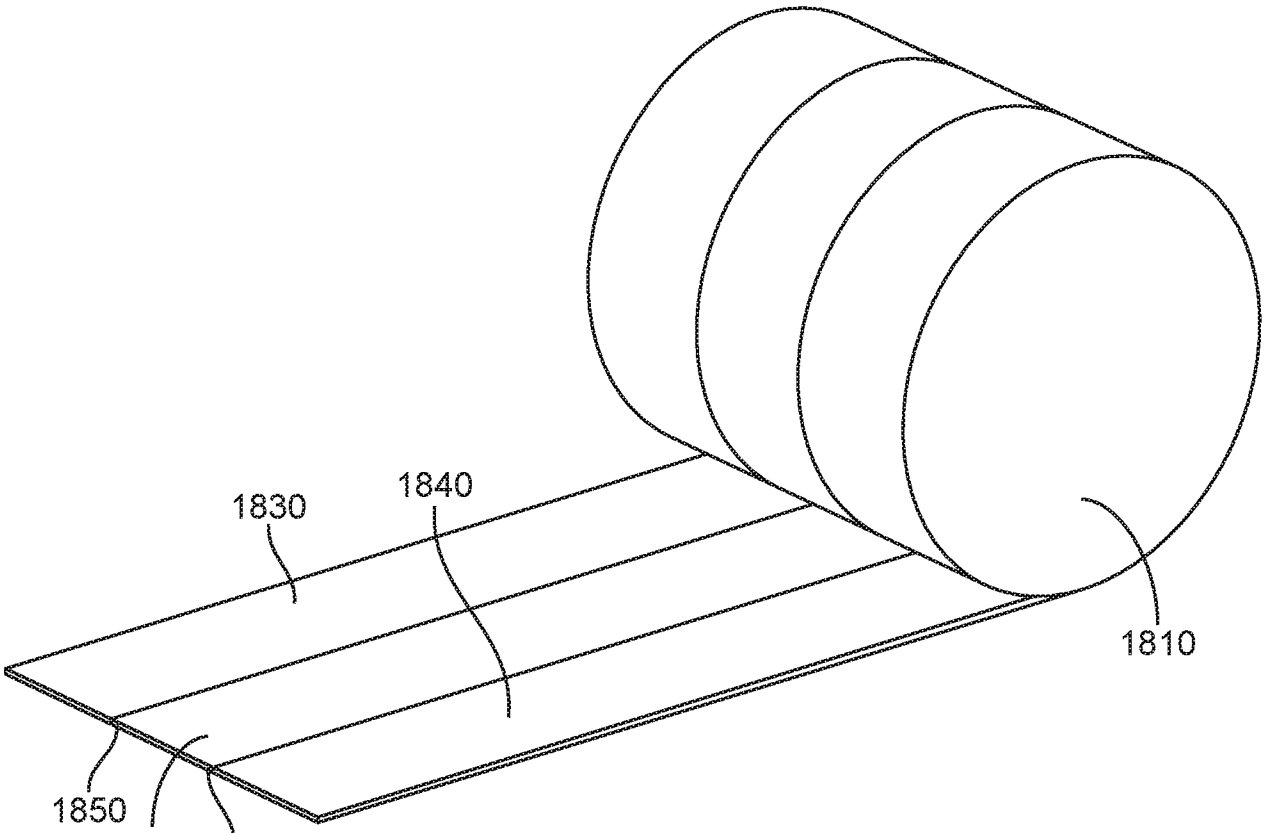
FIG. 18 illustrates a roll of material that can be stamped to form contacts according to an embodiment of the present invention.

FIG. 18 illustrates a roll of material that can be stamped to form contacts according to an embodiment of the present invention. A strip of precious-metal alloy 1820 can be butt-welded or otherwise fixed or attached to edges 1850 of copper alloy strips 1830 and 1840. These strips can be rolled into roll 1810 for handling and manufacturing purposes. In various embodiments of the present invention, contacts can be stamped such that all, or portions of, contacts are formed of precious-metal alloy 1820. In these and other embodiments of the present invention, carriers, which can be used to handle the contacts during manufacturing, can be formed in the copper alloy strips 1830 and 1840. In various embodiments of the present invention, the comparative width of these strips can vary. Also, the materials used can vary. For example, precious-metal alloy 1820 can be replaced with another material. Copper alloy strips 1830 and 1840 can instead be formed of copper, steel, or other material. Examples showing how contacts can be stamped to be fully or partially formed of precious-metal alloy 1820 are shown in the following figures.

Figure 19:
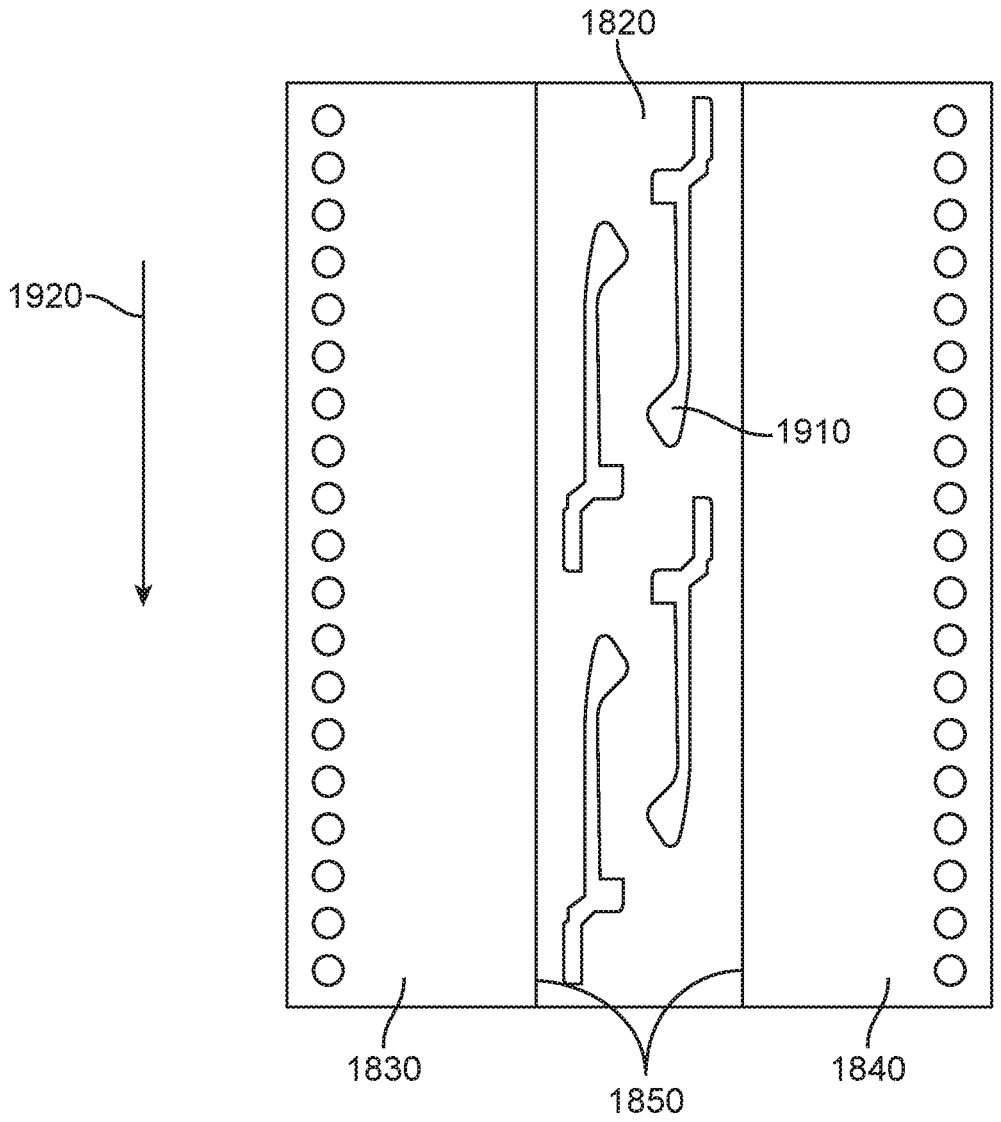
FIG. 19 illustrates a pattern that can be employed in stamping contacts according to an embodiment of the present invention.

FIG. 19 illustrates a pattern that can be employed in stamping contacts according to an embodiment of the present invention. As before, a strip of precious-metal alloy 1820 can be butt-welded at edges 1850 to copper alloy strips 1830 and 1840. In this example, contacts 1910 can be stamped such that they are fully formed of precious-metal alloy 1820. Carriers (not shown), can be formed in the copper alloy strips 1830 and 1840. With the contacts 1910 in this longitudinal direction, the usage of the precious-metal alloy 1820 is good. Also, the grain direction is such that the durability of the resulting contacts can be good. In this embodiment the present invention, a feed direction into a stamping machine can be indicated by arrow 1920.

Figure 20:
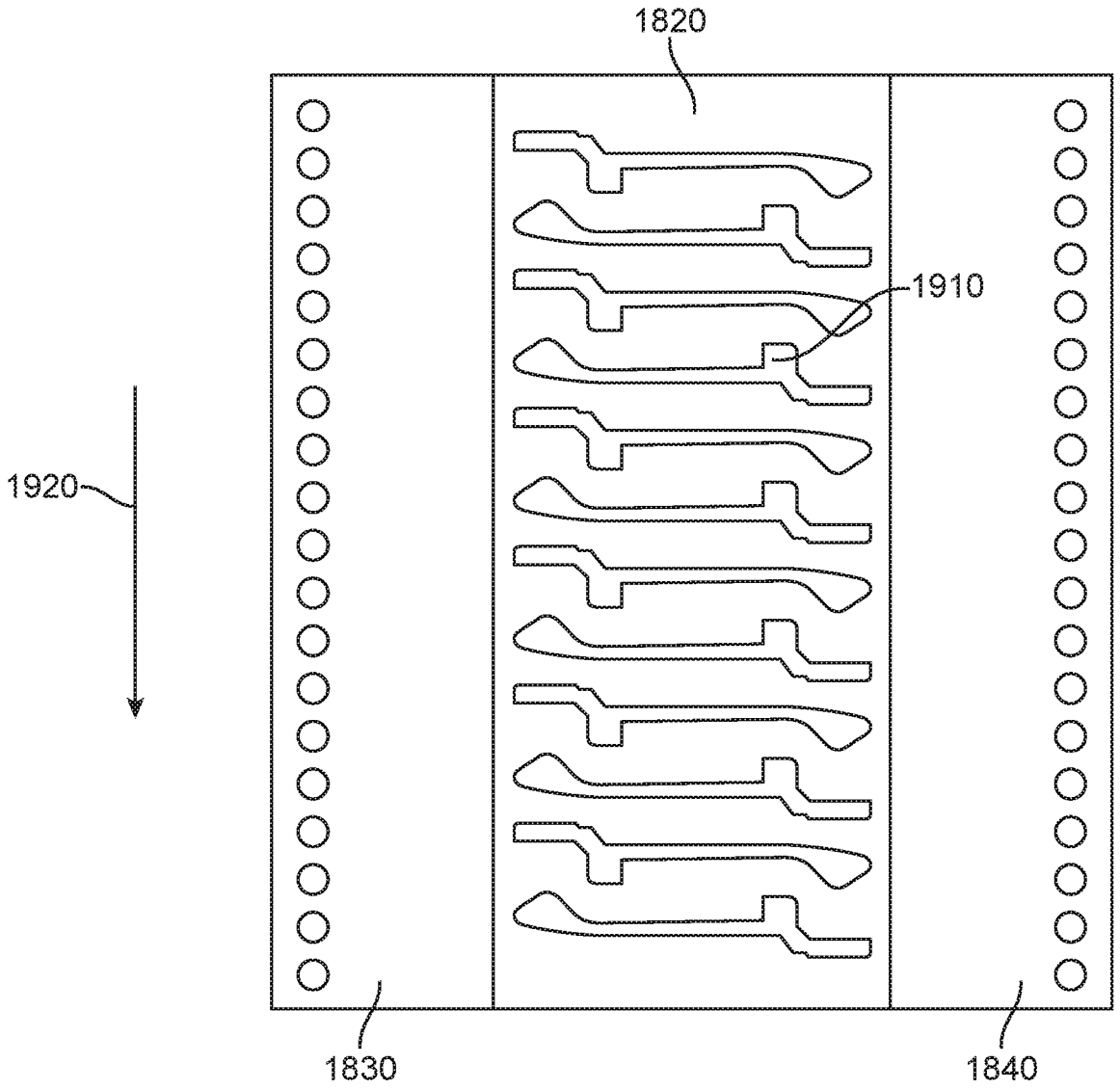
FIG. 20 illustrates another pattern that can be employed in stamping contacts according to an embodiment of the present invention.

FIG. 20 illustrates another pattern that can be employed in stamping contacts according to an embodiment of the present invention. As before, a strip of precious-metal alloy 1820 can be butt-welded at edges 1850 to copper alloy strips 1830 and 1840. Contacts 1910 can be stamped such that they are fully formed of precious-metal alloy 1820. Carriers (not shown) can be formed in copper alloy strips 1830 and 1840. With contacts 1910 in this transverse direction, material utilization can be improved over the example of FIG. 19, though the grain direction might not be as optimal. As before, a feed direction into a stamping machine can be indicated by arrow 1920.

Figure 21:
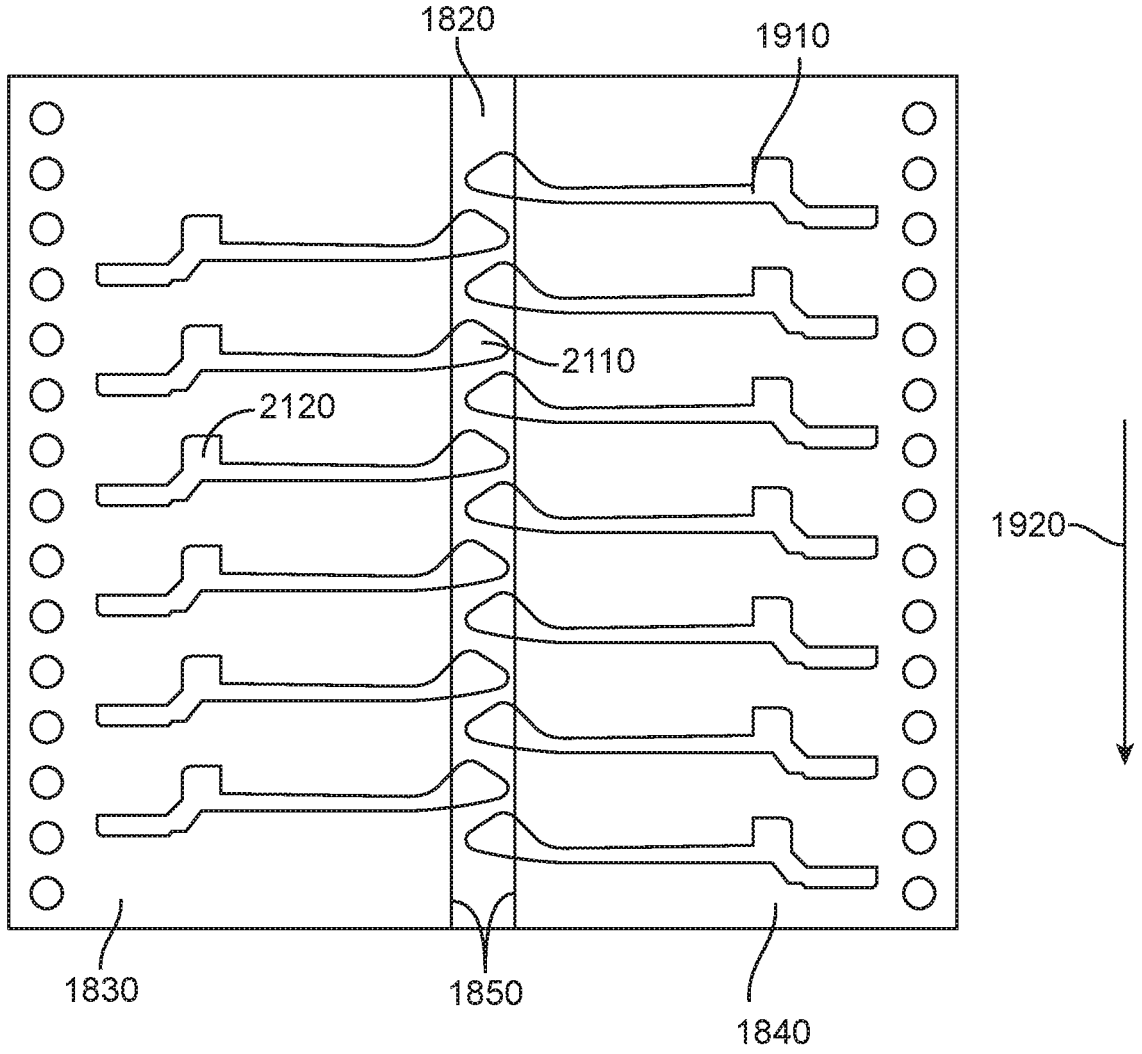
FIG. 21 illustrates another pattern that can be employed in stamping contacts according to an embodiment of the present invention.

FIG. 21 illustrates another pattern that can be employed in stamping contacts according to an embodiment of the present invention. As before, a strip of precious-metal alloy 1820 can be butt-welded at edges 1850 to copper alloy strips 1830 and 1840. In this example, a contacting portion 2110 of contacts 1910 can be formed of precious-metal alloy 1820, while a remainder 2120 of contacts 1910 can be formed in the copper alloy strips 1830 and 1840. As before, a feed direction into a stamping machine can be indicated by arrow 1920.

In these and other embodiments of the present invention, precious-metal-alloy layers or contact portions, such as precious-metal alloy 1820, can be a high entropy material, such as materials consistent with ASTM Standards B540, B541, B563, B589, B683, B685, or B731, yellow gold, or other materials. The material for the precious-metal alloy 1820 can be selected to have a good hardness and strength, as well as a high conductivity or low electrical resistance. A material having a good formability or high elongation for improved manufacturability can be selected for use as the precious-metal alloy 1820. In various embodiments of the present invention, the precious-metal alloy 1820 can have a Vickers hardness below 100, between 100-200, between 200-300, over 300, or a hardness in another range.

These and other embodiments of the present invention can include various plating layers at a contacting or other portion of a contact. Examples are shown in the following figure.

Figure 22:
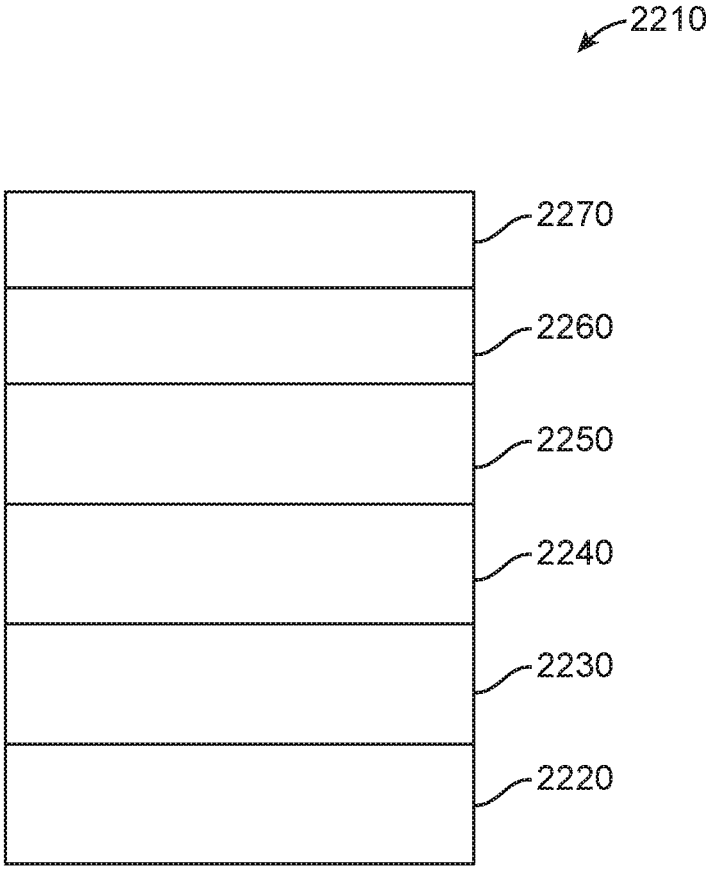
FIG. 22 illustrates contact plating layers according to an embodiment of the present invention.

FIG. 22 illustrates plating layers according to an embodiment of the present invention. In this example, contacts such as the contacts shown in the various examples herein can be plated with plating stack 2210. Also, other types of contacts, for example contacts formed by stamping or other process, and formed of copper, copper alloy, or other material, can be plated with this plating stack 2210. After stamping or other manufacturing step, an electropolish step can be used to removing stamping burrs from the substrate, which could otherwise expose nickel silicides or other particles in the substrate. Unfortunately, the electropolish step can leave nodules on the contact surface. Chemical polish can be used in its place, though a chemical polish can leave nodes behind on the contact surface.

Accordingly, a first plating layer 2220 can be plated on the substrate to provide a surface leveling. This first plating layer 2220 can be copper or other material, such as gold, nickel, tin, tin copper, hard gold, or gold cobalt, and it can be plated over the contact substrate to level the surface of the substrate and cover nodules left by electropolishing, or nodes left by chemical polishing, as well as remaining burrs or other defects from the stamping process. In these other embodiments of the present invention, the first plating layer 2220 can be sufficient and an electropolish step can be omitted. The first plating layer 2220 can also provide adhesion between the substrate and a second plating layer 2230 that can be plated over the first plating layer 2220. The first plating layer 2220 can have a thickness of 0.5 to 1.0 micrometers, 1.0 to 3.0 micrometers, 3.0 to 4.5 micrometers, 3.0 to 5.0 micrometers, or more than 5.0 micrometers, or it can have a thickness in a different range of thicknesses. In other embodiments of the present invention, this first plating layer 2220 can be omitted.

Cracks in these plating layers can provide pathways for fluids that can cause corrosion. Accordingly, a second, harder plating layer 2230 to prevent layers above it from cracking can be plated over the first plating layer 2220. This second plating layer 2230 can be formed of an electroless nickel composite. This second plating layer can be formed of a nickel-tungsten alloy. This second plating layer 2230 can have a thickness of 0.5 to 1.0 micrometers, 1.0 to 2.0 micrometers, 2.0 to 5.0 micrometers, or more than 5.0 micrometers, or it can have a thickness in a different range of thicknesses. In other embodiments of the present invention, this second plating layer 2230 can be omitted.

A third plating layer 2240 can work in conjunction with the second plating layer 2230. The third plating layer 2240 can be plated over the second plating layer. This third plating layer 2240 can be soft to absorb shock and thereby minimize cracking in the layers above the third plating layer 2240. The third plating layer 2240 can be gold or other material such as copper, nickel, tin, tin copper, hard gold, or gold cobalt. The third plating layer 2240 can provide adhesion between its neighboring layers and can provide a leveling effect as well. This third plating layer 2240 can have a thickness of 0.55 to 0.9 micrometers, 0.5 to 1.25 micrometers, 1.25 to 2.5 micrometers, 2.5 to 5.0 micrometers, or more than 5.0 micrometers, or it can have a thickness in a different range of thicknesses. In various embodiments of the present invention, these second plating layer 2230 and third plating layer 2240 can be omitted, or the second plating layer 2230 can be omitted, though other layers can be added or omitted as well or instead.

A fourth plating layer 2250 to provide corrosion resistance can be plated over third plating layer 2240. The fourth plating layer 2250 layer can act as a barrier layer to prevent color leakage to the surface of the contact, and the material used for the fourth plating layer 2250 can be chosen on this basis. This layer can be formed of palladium or other material such as nickel, tin-copper, or silver. The use of palladium or other material can provide a fourth plating layer 2250 that is more positively charged than a top plate 2270 of rhodium-ruthenium, rhodium, or other material. This can cause the top plate 2270 to act as a sacrificial layer, thereby protecting the underlying palladium in fourth plating layer 2250. This fourth plating layer 2250 can be somewhat harder than a fifth plating layer 2260 above it, which can prevent layers above the fourth plating layer 2250 from cracking when exposed to pressure during a connection. The fourth plating layer 2250 can have a thickness of 0.5 to 0.8 micrometers, 0.5 to 1.0 micrometers, 1.0 to 1.5 micrometers, 1.5 to 3.0 micrometers, or more than 3.0 micrometers, or it can have a thickness in a different range of thicknesses. When palladium is used, it can be plated at a rate of 0.6 plus or minus 0.1 ASD or other appropriate rate.

A fifth plating layer 2260 to act as an adhesion layer between the fourth plating layer 2250 and a top plate 2270 can be plated over the fourth plating layer 2250. The fifth plating layer 2260 can be gold or other material such as copper, nickel, tin, tin copper, hard gold, or gold cobalt. The fifth plating layer 2260 layer can also provide further leveling. The fifth plating layer 2260 layer can have a thickness of 0.02 to 0.05 micrometers, 0.05 to 0.15 micrometers, 0.10 to 0.20 micrometers, 0.15 to 0.30 micrometers, or more than 0.30 micrometers, or it can have a thickness in a different range of thicknesses.

A top plate 2270 can be formed over the fifth plating layer 2260. The top plate 2270 can be highly corrosive and wear resistant. This top plate 2270 can be thinned in high-stress locations to reduce the risk of cracking. Top plate 2270 can provide a durable contacting surface for when the contact on the electronic device housing the contact is mated with a corresponding contact on a second electronic device. In various embodiments of the present invention, top plate 2270 can have a Vickers hardness below 100, between 100-200, between 200-300, over 300, or a hardness in another range. Top plate 2270 can be formed using rhodium-ruthenium, dark rhodium, dark ruthenium, gold copper, or other alternatives. The use of rhodium-ruthenium or rhodium can help oxygen formation, which can reduce its corrosion. The percentage of rhodium can be between 85 to 100 percent by weight, for example, it can be 95 or 99 percent by weight, where the most or all of the remaining material is ruthenium. This material can be chosen for its color, wear, hardness, conductivity, scratch resistance, or other property. The top plate 2270 can have a thickness less than 0.5 micrometers, between 0.5 and 0.75 micrometers, between 0.65 and 1.0 micrometers, 0.75 and 1.0 micrometers, between 1.0 and 1.3 micrometers, more than 1.3 micrometers, or it can have a thickness in a different range of thicknesses.

In various embodiments of the present invention, these layers can be varied. For example, top plate 2270 can be omitted over portions of the contact for various reasons. For example, where a contact has a surface-mount or through-hole contacting portion to be soldered to a corresponding contact on a printed circuit board, top plate 2270 can be omitted from the surface-mount or through-hole contacting portion. In other embodiments of the present invention, other layers, such as the second plating layer 2230 and third plating layer 2240, can be omitted.

Also, in these and other embodiments of the present invention, one or more plating layers can be applied at a varying thickness along a length of the contact. In these embodiments, drum plating can be used. A contact on a carrier can be aligned with a window on a first drum though which physical vapor deposition or other plating step can occur. The window on the first drum can have an aperture that is varied during rotation by a window on a second drum, the second drum inside the first drum. An example is shown in the following figure.

Figure 23:
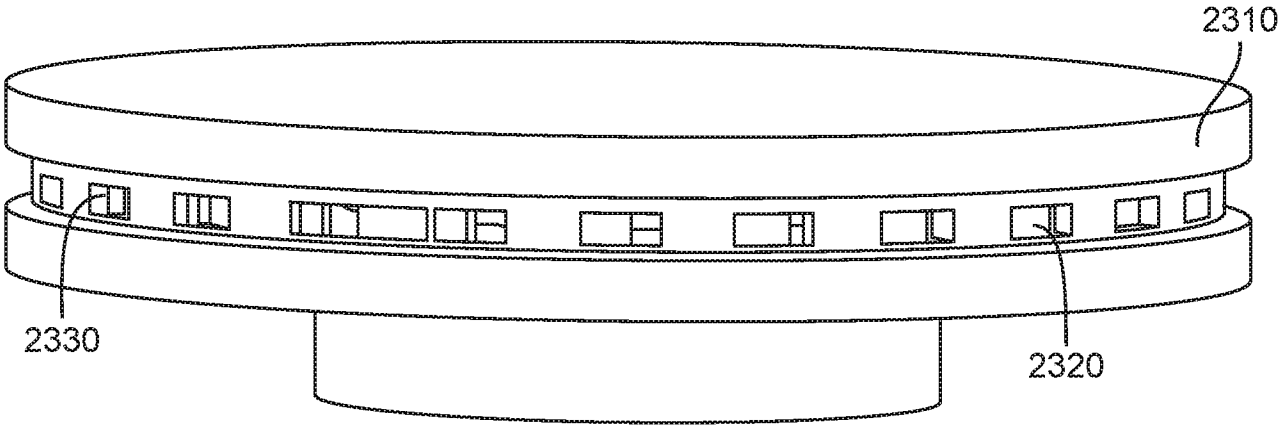
FIG. 23 illustrates a dual-drum that can be used in plating a contact according to an embodiment of the present invention.
Figure 27:
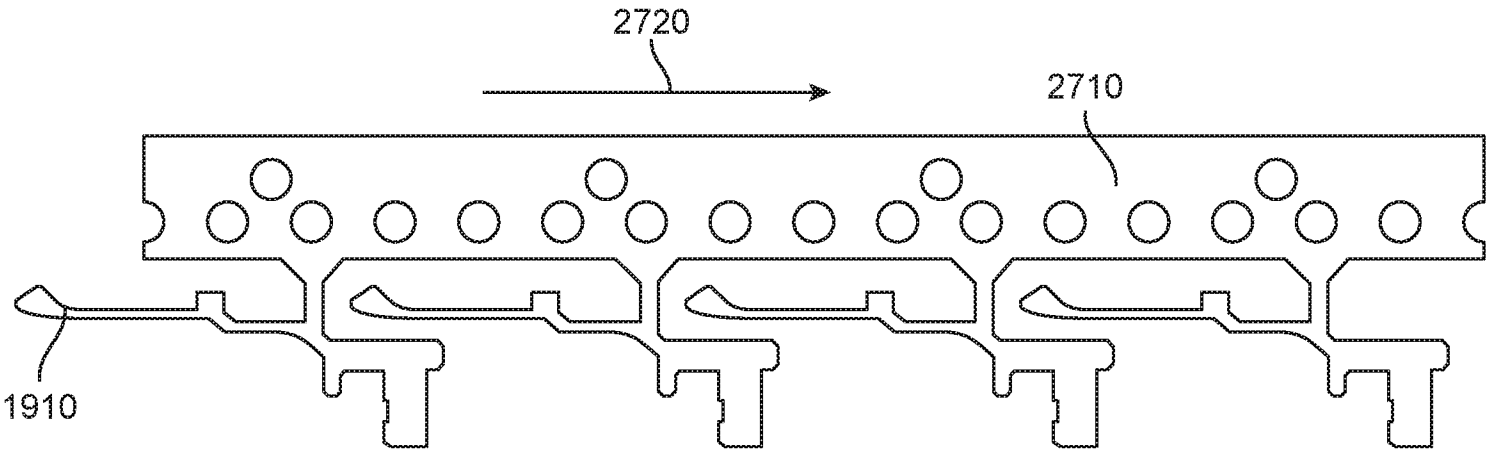
FIG. 27 illustrates a number of contacts and a carrier according to an embodiment of the present invention.

FIG. 23 illustrates a dual-drum that can be used in plating a contact according to an embodiment of the present invention. In this example, an outside drum 2310 can have a number of windows 2320 around an outside edge. Contacts on a carrier (as shown in FIG. 27) can be aligned to each window 2320. The outside drum 2310 can rotate and a plating layer can be formed on the contacts. The aperture of each window 2320 can vary during rotation and can be modulated by windows 2330 on a second inside drum (not shown), where the inside drum turns at a higher rate than the outside drum 2310. The variation in aperture during rotation can cause portions of the contacts that are exposed for longer durations to receive more plating. An example of this variation in aperture is shown in the following figure.

Figure 24:
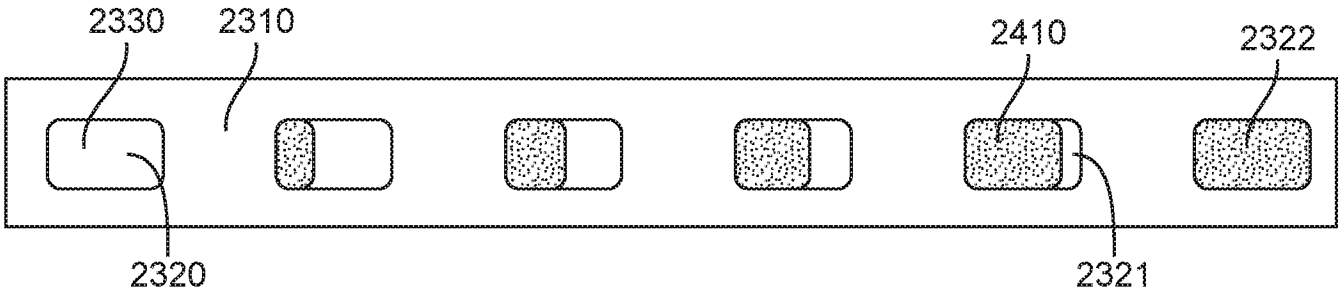
FIG. 24 illustrates an aperture of a plating window of the dual-drum of FIG. 23.

FIG. 24 illustrates an aperture of a plating window of the dual-drum of FIG. 23. A contact on a carrier (as shown in FIG. 27) can be aligned with each window 2320 on outside drum 2310. When a window 2330 on the inside drum is aligned with a window 2320 on the outside drum, the aperture is fully opened and an entire contact (or entire portion of a contact) can be plated. As the inside drum rotates relative to the outside drum 2310, an obstructing portion 2410 between windows 2330 on the inside drum can progressively block window 2320. This narrowing aperture can be indicated as 2321 and 2322 in this figure. An example of a contact that can be plated using this dual-drum apparatus is shown in the following figure.

Figure 25:
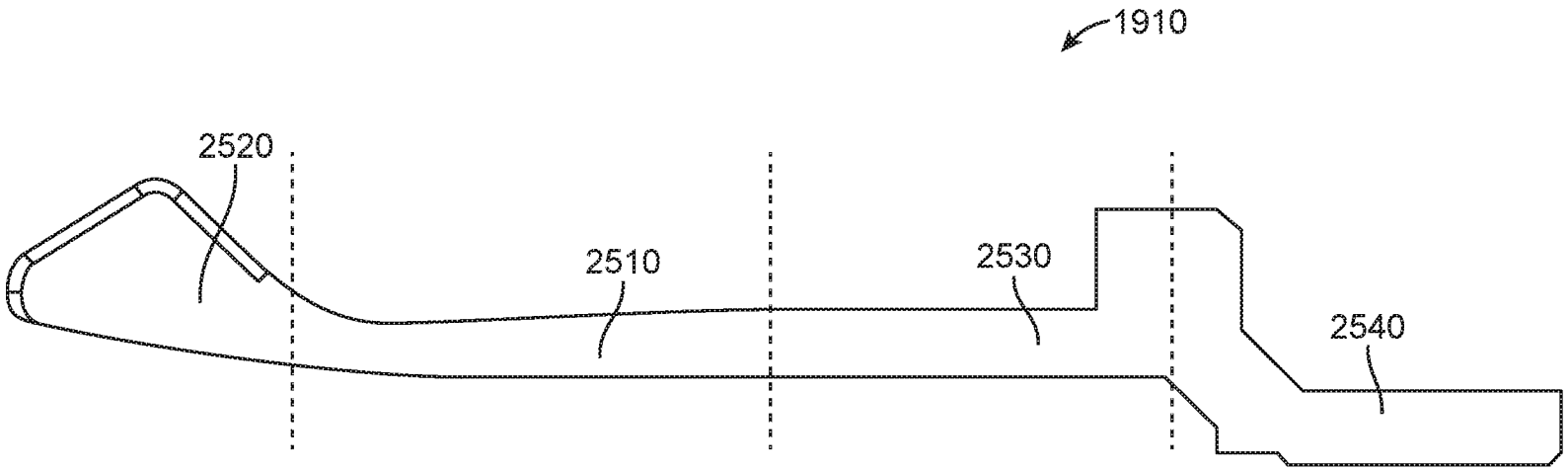
FIG. 25 illustrates a contact that can be plated according to an embodiment of the present invention.

FIG. 25 illustrates a contact that can be plated according to an embodiment of the present invention. Contact 1910 can have a high-wear contacting portion 2510 to mate with a contact in a corresponding connector. Contact 1910 can have a low-stress beam portion 2520, a high-stress beam portion 2530, and a contacting portion 2540, such as a surface-mount or through-hole contacting portion for mating with a corresponding contact on a printed circuit board or other appropriate substrate (not shown). Accordingly, contact 1910 can have a hard layer that is thicker at the high-wear contacting portion 2510 to prevent wear, and thinner at the high-stress beam portion 2530 to avoid cracking, which again can act as a pathway for moisture seepage and thus corrosion.

Contacts, such as contacts 1910, can be located in a connector receptacle, a connector insert, or elsewhere in a connector system.

A substrate for contact 1910 can be stamped, for example from a sheet or strip of copper, or a strip that includes strips of copper welded to sides of a strip of a precious-metal alley, or as shown in any of the examples shown herein. An electropolish or chemical polish step can be used to removing stamping burrs, though they can leave nodules or nodes on the contact surface. Again, this contact 1910 can be plated in various embodiments of the present invention. An example is shown in the following figure.

Figure 26:
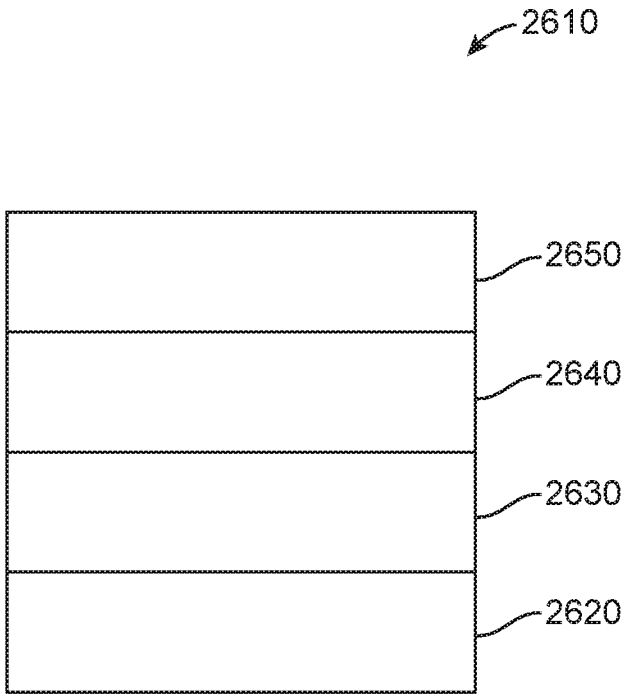
FIG. 26 illustrates plating layers according to an embodiment of the present invention.

FIG. 26 illustrates plating layers according to an embodiment of the present invention. In this example, a plating stack 2610 can include four layers, though in various embodiments of the present invention, there can be less than four or more than four layers. A first plating layer 2620 to provide a surface leveling can be plated on the substrate. This first plating layer 2620 can be copper or other material such as gold, nickel, tin, tin copper, hard gold, or gold cobalt, or other material, and first plating layer 2620 can be plated over the contact substrate to level the surface of the stamped substrate. In these other embodiments of the present invention, first plating layer 2620 can be sufficient and an electropolish step can be omitted. This first plating layer 2620 can also provide adhesion between its neighboring substrate and second plating layer 2630. First plating layer 2620 can have a thickness of 0.5 to 1.0 micrometers, 1.0 to 3.0 micrometers, 3.0 to 5.0 micrometers, or more than 5.0 micrometers, or it can have a thickness in a different range of thicknesses.

A second plating layer 2630 to provide corrosion resistance can be plated over first plating layer 2620. The second plating layer 2630 can act as a barrier layer to prevent color leakage to the surface of the contact, and the material used for the second plating layer 2630 can be chosen on this basis. This second plating layer 2630 can be formed of palladium or other material such as nickel, tin-copper, or silver. The use of palladium or other material can provide a second plating layer 2630 that is more positively charged than a top plate 2650 of rhodium-ruthenium, rhodium, or other material. This can cause the top plate to act as a sacrificial layer, thereby protecting the underlying palladium. This layer can be somewhat harder than a third plating layer 2640 above it, which can prevent layers above the second plating layer 2630 from cracking when exposed to pressure during a connection. The second plating layer 2630 can have a thickness that varies along a length of the contact. For example, it can vary from of 0.1 to 0.2 micrometers, 0.2 to 0.3 micrometers, 0.3 to 0.5 micrometers, 0.3 to 1.5 micrometers, 1.0 to 1.5 micrometers or more than 1.5 micrometers, or it can have a thickness in a different range of thicknesses along a length of a contact. The second plating layer 2630 can be thicker near a high-wear contacting portion, and it can thin away from the high-wear region. This can provide a thicker hard layer over contacting portion 2510 for wear resistance and a thinner hard layer over high-stress beam portion 2530 of contact 1910 (as shown in FIG. 25) to avoid cracking.

A third plating layer 2640 to act as an adhesion layer between the second plating layer 2630 and a top plate 2650 can be plated over the second plating layer 2630. The third plating layer 2640 can be gold or other material such as copper, nickel, tin, tin copper, hard gold, or gold cobalt. The third plating layer can also provide a leveling effect. The third plating layer 2640 can have a thickness of 0.02 to 0.05 micrometers, 0.05 to 0.15 micrometers, 0.15 to 0.30 micrometers, or more than 0.30 micrometers, or it can have a thickness in a different range of thicknesses along a length of a contact.

A top plate 2650 can be formed over the third plating layer. The top plate 2650 can be highly corrosive and wear resistant. This top plate 2650 can be thinned in the high-stress beam portion 2530 of contact 1910 (as shown in FIG. 25) to reduce the risk of cracking. The top plate 2650 can be thicker to provide a durable contacting surface for contacting portion 2510 of contact 1910 (as shown in FIG. 25) for when the contact on the electronic device housing the contact is mated with a corresponding contact on a second electronic device. In various embodiments of the present invention, the top plate 2650 can have a Vickers hardness below 100, between 100-200, between 200-300, over 300, or a hardness in another range. The top plate 2650 can be formed using rhodium-ruthenium, dark rhodium, dark ruthenium, gold copper, or other alternatives. The use of rhodium-ruthenium or rhodium can help oxygen formation, which can reduce its corrosion. The percentage of rhodium can be between 85 to 100 percent by weight, for example, it can be 95 or 99 percent by weight, where the most or all of the remaining material is ruthenium. This material can be chosen for its color, wear, hardness, conductivity, scratch resistance, or other property. Top plate 2650 can have a thickness less than 0.3 micrometers, between 0.3 and 0.55 micrometers, between 0.3 and 1.0 micrometers, between 0.75 and 1.0 micrometers, more than 1.0 micrometers, or it can have a thickness in a different range of thicknesses. Again, top plate 2650 can be omitted from the surface-mount or through-hole contacting portion of contact 1910 (as shown in FIG. 25).

FIG. 27 illustrates a number of contacts and a carrier according to an embodiment of the present invention. In this example, a number of contacts 1910 can be attached to a carrier 2710. A roll direction can be indicated by arrow 2720.

In these and other embodiments of the present invention, other layers can be formed on contacts to prevent wear and corrosion. An example is shown in the following figure.

Figure 28:
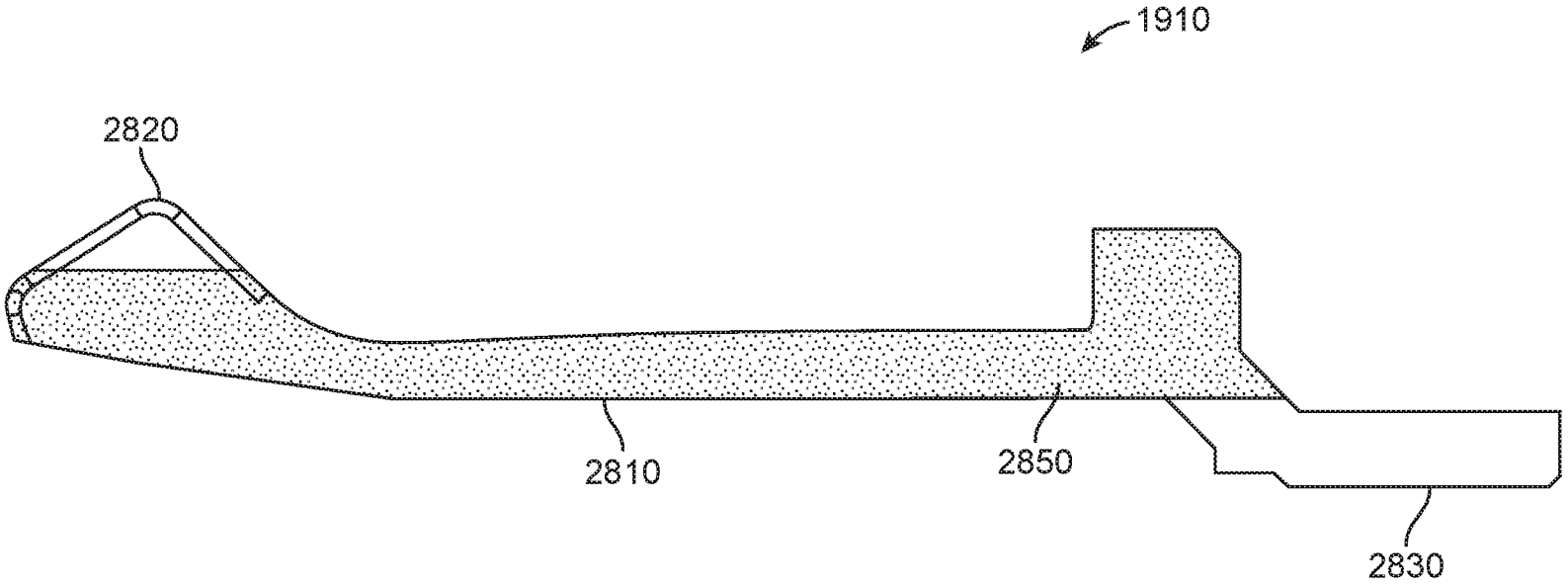
FIG. 28 illustrates a contact partially plated with plastic, resin, or other material according to an embodiment of the present invention.

FIG. 28 illustrates a contact partially plated with plastic, resin, or other material according to an embodiment of the present invention. In this example, a plastic insulating layer or coating 2850 can be formed using electrophoretic deposition (ED) or other appropriate method. This layer or coating 2850 can cover portion of a contact 1910, primarily beam 2810, to prevent corrosion. A contacting portion 2820 of contact 1910 can remain exposed such that it can form an electrical connection with a contact in a corresponding connector. Also, a surface-mount contacting portion 2830 or through-hole contact portion (not shown) can remain exposed such that it can be soldered to a corresponding contact on a board or other appropriate substrate.

Figure 29:
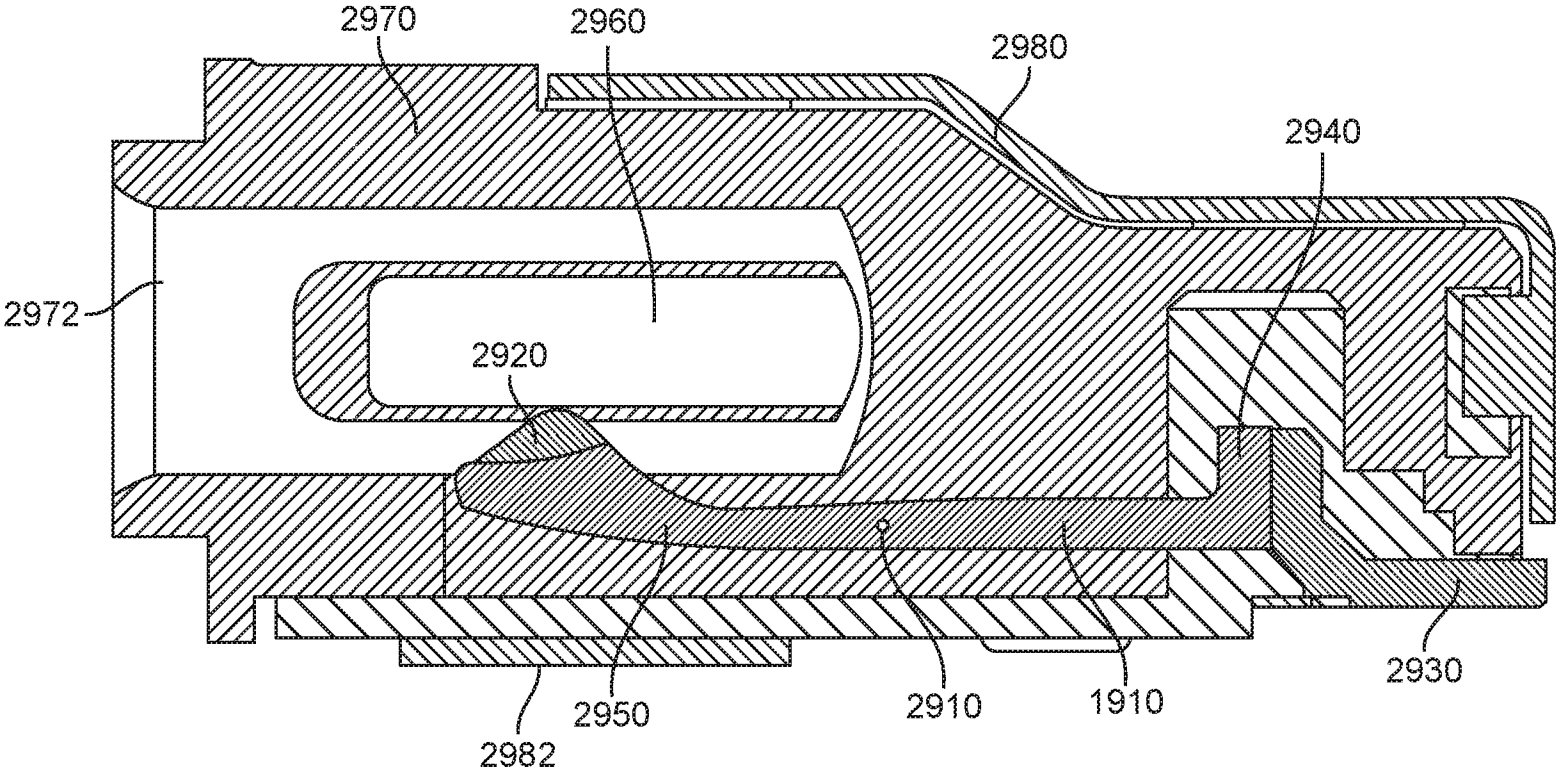
FIG. 29 illustrates a connector receptacle including a contact partially plated with plastic, resin, or other material according to an embodiment of the present invention.

FIG. 29 illustrates a connector receptacle including a contact partially plated with plastic, resin, or other material according to an embodiment of the present invention. This connector can include a number of contacts 1910 supported by a housing 2970. Housing 2970 can include a front opening 2972 for accepting a connector insert (not shown) and can be at least partially surrounded by top shield 2980 and bottom shield 2982. Side ground contact 2960 can contact a shield of the connector insert when the connector insert is inserted into the connector receptacle.

Each contact 1910 can include beam 2910, contacting portion or contact area 2920, surface-mount contact portion 2830, and mechanical stabilizing portion 2940. Contacting portion or contact area 2920 can mate with a contact in a corresponding connector insert when the connector insert is inserted into the connector receptacle. Surface-mount contact portion 2830 can be soldered to a flexible or printed circuit board or other appropriate substrate to form an electrical connection to traces and planes in the board. Mechanical stabilizing portion 2940 can be molded or inserted into housing 2970 to fix contact 1910 in place in the connector receptacle.

Beam 2910 can deflect when a connector insert is inserted into the connector receptacle. This deflection can make the beam more susceptible to cracking due to corrosion. This effect can be referred to as stress corrosion cracking. Similarly, the effects of corrosion can be more severe at the beam due to this defection. That is, there can be either more corrosion, or more sensitivity to corrosion, at base of beam 2910 near mechanical stabilizing portion 2940, such that small amounts of corrosion can destroy or damage contact 1910. In some contacts, plating on base of beam 2910 can crack and fatigue, and this can cause corrosion to accelerate.

Accordingly, these and other embodiments of the present invention can use electrophoretic deposition (ED) or other appropriate method to form ED coating 2950 to protect beam 2910 from corrosion. This electrophoretic deposition can form a nonconductive coating, though in these and other embodiments of the present invention, the coating can be conductive or partially conductive. In these and other embodiments of the present invention, the electrophoretic deposition process used can be an electrocoating, cathodic or anodic electrodeposition, electroplastic deposition, electro deposition, electrophoretic coating, electrophoretic painting, or other appropriate process.

Contact 1910 can be formed in various ways. For example, contact 1910 can have either or both contacting area 2920 and surface mount contact portion 2930 covered by a masking layer. The masking layer can be wax, paraffin, or other material. This material can be applied mechanically, by printing, such as with an ink jet, roller, pad, or other applicator, or by other method.

Contact 1910 can then be coated with ED coating 2950. In these and other embodiments of the present invention, the coating material can be an acrylic resin, plastic, or other material. The acrylic resin, or other material, can be mixed with either or both ether and alcohol or other volatile solvents. For example, the coating material can be an acrylic resin mixed with volatile solvents, such as alcohol, butanol, ethaline, glycol, mono-butyl, and others. The ether and alcohol can allow the resin to be in liquid form before application. Contact 1910 can be placed in this bath at a high voltage, for example 20-100 volts. The voltage can attract resin ions to contact 1910 and the resin can form ED coating 2950 on contact 1910.

After ED coating 2950 has been applied, the masking layer can be removed. For example, where the masking layer is wax, it can be removed using hot water. This can also help to set the ED coating 2950 on contact 1910.

As shown in FIG. 21 above, in some embodiments of the present invention, a tip of contact 1910 can be formed of a precious-metal alloy. In this example, the contact area 2920 (and 2820 in FIG. 28) can be formed of precious-metal alloy while other materials can be used to form beam 2910, since beam is coated with ED coating 2950. The use of resin or other ED coating 2950 can allow the use of a mix of materials. For example, a hard, precious-metal alloy or other material can be used for contact areas 2920 without the consequence of having a brittle beam 2910. This can allow the beam 2910 to be formed of a more flexible, less brittle material. Moreover, the gradient coating techniques shown in FIG. 25 above can be employed as well.

Where contacting area 2920 is formed of a precious-metal alloy, it can be desirable to save resources by reducing its size. This can require a more accurate application of the masking layer. Accordingly, in these and other embodiments of the present invention the masking layer can be formed by printing, such as with an ink jet, roller, pad, or other applicator. These and other embodiments of the present invention can provide contacts that are formed using 3-D printing. The precious-metal alloys used can be the same or similar to those in the examples herein and consistent with other embodiments of the present invention.

Contacts, such as contacts 1910 and the other contacts in these examples, can be formed of various materials. For example, the beams and other contact portions can be formed of copper or other materials. The beams and other portions can be plated with various layers, such as those shown in FIGS. 4, 9, 22, and 26.

Contacts, such as contacts 1910, can be formed in various ways in these and other embodiments of the present invention. An example is shown in the following figure.

Figure 30:
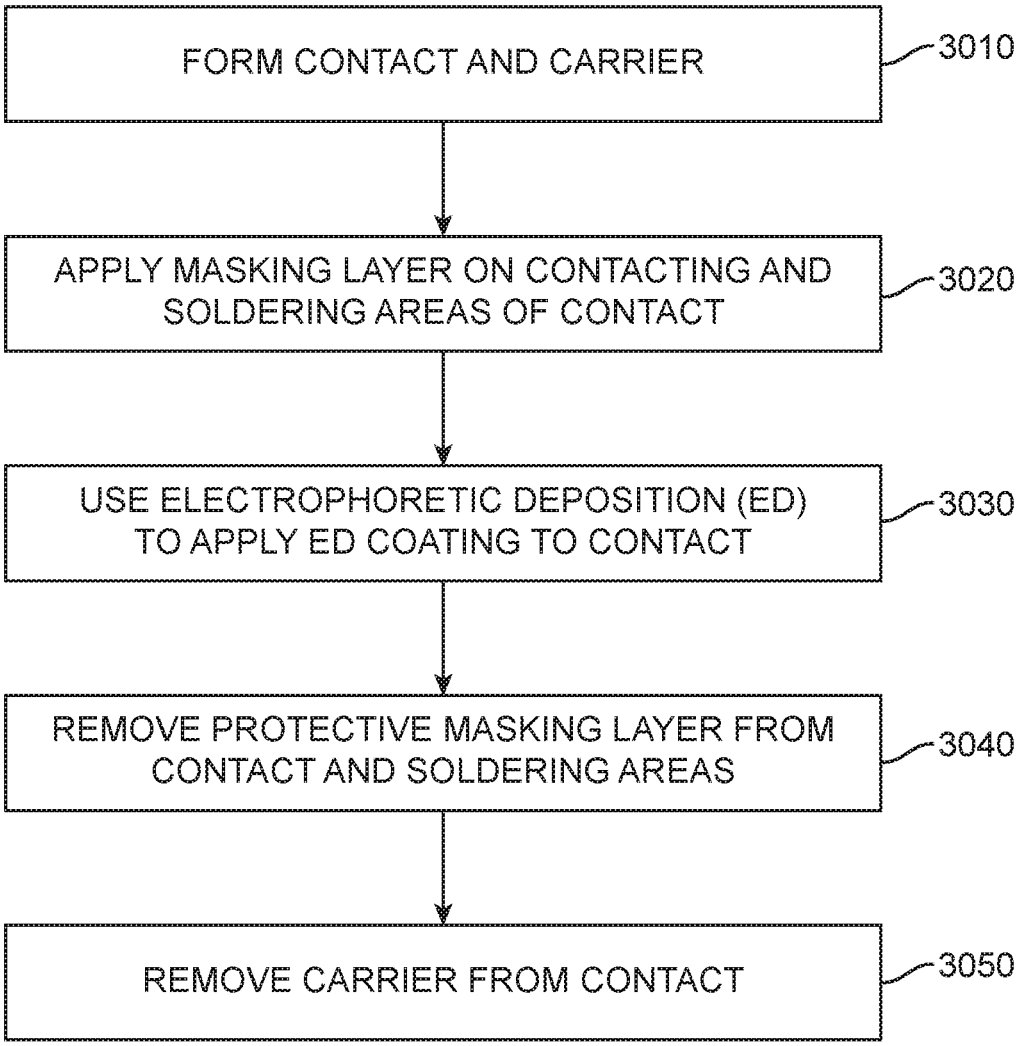
FIG. 30 illustrates a method of manufacturing a contact partially plated with plastic, resin, or other material according to an embodiment of the present invention.

FIG. 30 illustrates a method of manufacturing a contact partially plated with plastic, resin, or other material according to an embodiment of the present invention. In act 3010, a contact, such as contact 1910, and a carrier can be formed. The contact and its carrier can be formed by stamping, forging, molding, metal-injection molding, 3-D printing, or other manufacturing process, for example the process shown in FIG. 21 or any of the other processes shown herein or otherwise consistent with embodiments of the present invention. The contacts can be plated, for example using layers as shown in FIGS. 4, 9, 22, and 26. A masking layer can be applied to a contact area, such as contact area 2920, in act 3020. Other regions, such as surface mount contact portion 2930, can be masked as well. This masking layer can be applied mechanically, by printing, such as with an ink jet, roller, pad, or other applicator, or by other method. The masking layer can be formed of wax, paraffin, or other material.

In act 3030, an electrophoretic coating, such as ED coating 2950, can be applied to the contact using electrophoretic deposition or other appropriate method. In these and other embodiments of the present invention, the electrophoretic deposition process used can be an electrocoating, cathodic or anodic electrodeposition, electroplastic deposition, electro deposition, electrophoretic coating, electrophoretic painting, or other appropriate process. In these and other embodiments of the present invention, the coating material can be an acrylic resin, plastic, or other material. The coating material can be nonconductive. The acrylic resin, or other material, can be mixed with either or both ether and alcohol. For example, the coating material can be an acrylic resin mixed with volatile solvents, such as alcohol, butanol, ethaline, glycol, mono-butyl, and others. The ether and alcohol can allow the coating material to be in liquid form. The contact, such as contact 1910, can be placed in this bath at a high voltage, for example 20-100 volts. The voltage can attract resin ions to contact, and the resin can form the ED coating 2950 on the contact.

After the ED coating has been applied in act 3030, the masking layer can be removed in act 3040. For example, where the masking layer is wax, it can be removed using hot water. This can also help to set the ED coating on the contact. The carrier can be removed in act 3050. The contact, such as contact 1910, can then be inserted in a connector receptacle, such as the connector receptacle shown in FIG. 29 above.

These and other embodiments of the present invention can provide a plating stack that is very hard and corrosion resistant, as well as wear resistant. Unfortunately, this hard plating stack can crack or create discontinuities when bent or stressed. This can be particularly problematic along portions of a flexible beam of a contact, which can bend when the contact is mated with a corresponding contact. As such, a contact with this hard plating stack can crack at its beam portion. These cracks can create a short corrosion path to an underlying substrate and other reactive layers in the hard plating stack, thereby accelerating corrosion of the contact.

Accordingly, embodiments of the present invention can provide this hard plating stack to a contacting portion of a contact and can limit or reduce the number of plating layers in the plating stack in a flexible beam area. Where a contact does not include a flexible beam portion, this hard plating stack can be used over a contacting portion and other portions of the contact. An example where this plating is used on a beam contact is shown in the following figure.

Figure 31:
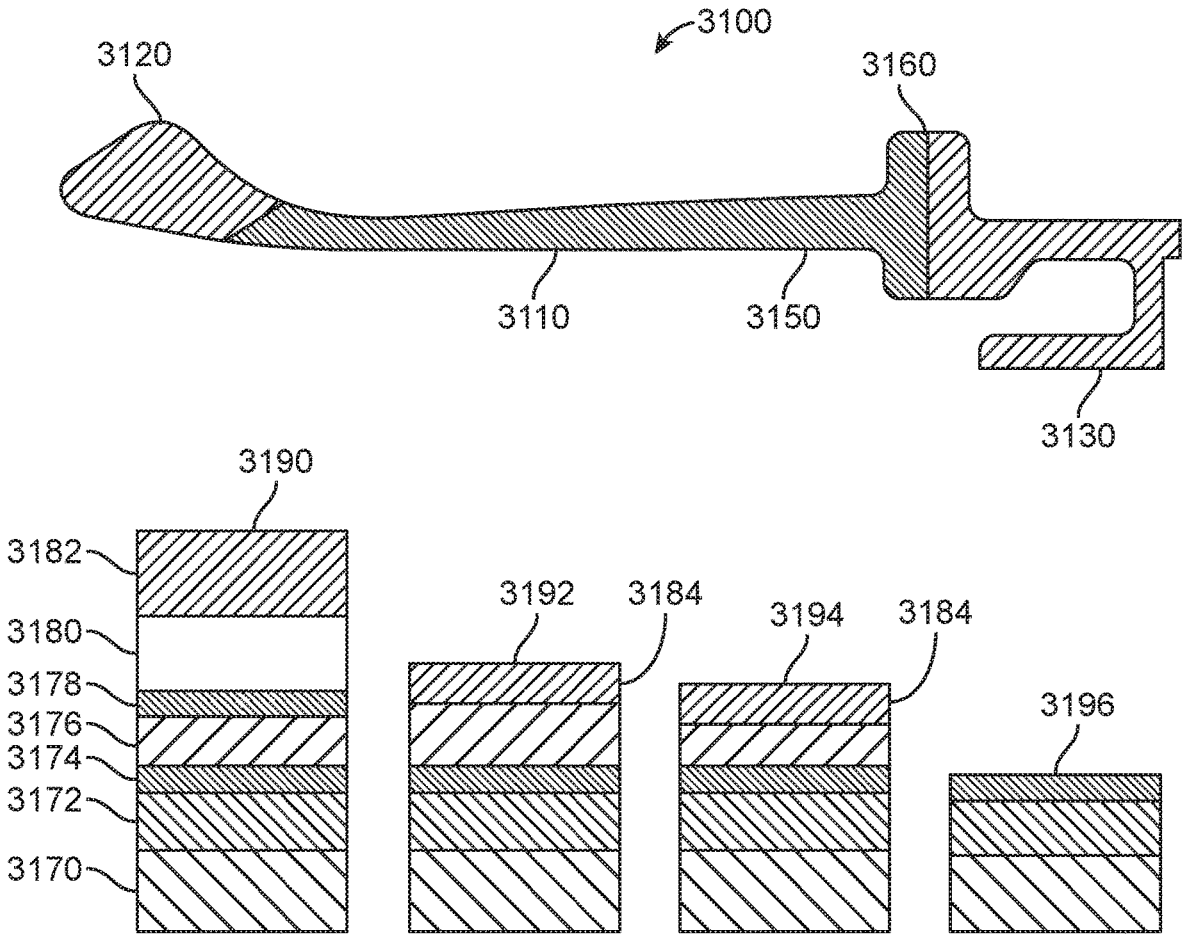
FIG. 31 illustrates another contact and its plating stacks according to an embodiment of the present invention.

FIG. 31 illustrates another contact and its plating stacks according to an embodiment of the present invention. These plating stacks can provide a very hard plating stack over contacting portion 3120 of contact 3100 and a ductile plating stack over contact beam portions 3110 and 3150. This combination can provide a very hard corrosion resistant contacting portion 3120 while also providing ductile corrosion resistant beam portions 3110 and 3150.

Plating stack 3190 can be used to plate contacting portion 3120 of contact 3100. Plating stack 3192 can be used to plate beam portion 3110 near contacting portion 3120, while plating stack 3194 can be used to plate beam portion 3150 at an end of the beam of contact 3100. Plating stack 3196 can be used for plating surface-mount portion 3130 of contact 3100. Tab 3160 can provide mechanical stability and can be used to hold contact 3100 in place in a connector receptacle. For example, an insert molded portion can be formed around tab 3160.

In these and other embodiments of the present invention, a substrate formed of copper or copper alloy, niobium and its alloys, tantalum and its alloys, aluminum, aluminum alloy, stainless steel, rhodium, rhodium alloy, ruthenium, ruthenium alloy, rhodium-ruthenium, rhodium-iridium, other platinum group elements (palladium, osmium, iridium, and platinum) and their alloys, B540, B541, B563, B589, B683, B685, or B731, titanium, titanium alloy, gold, gold alloy, silver, silver alloy, other precious metal or its alloys, or other material, can be used for contact 3100.

A leveling layer 3170 can be formed over contact 3100. This leveling layer 3170 can be plated over contacting portion 3120, beam portion 3110, beam portion 3150, and surface-mount portion 3130. That is, leveling layer 3170 can be the first plating layer in plating stack 3190, plating stack 3192, plating stack 3194, and plating stack 3196. This leveling layer 3170 can be formed of copper or other material and can have a thickness of 1.0 micrometers, 2.0 micrometers, 3.0 micrometers, 4.0 micrometers, 0.5 to 1.0 micrometers, 1.0 to 3.0 micrometers, 2.0 to 4.0 micrometers, or more than 4.0 micrometers, or it can have a different thickness or a thickness in a different range of thicknesses.

A nickel-based layer 3172, such as a tin-nickel, nickel-tungsten, nickel phosphate, electroless nickel, nickel based metal, palladium-nickel, nickel-copper, or other nickel based layer or other material, can be formed over the leveling layer. This nickel-based layer can be a support layer. Nickel-based support layer 3172 can be plated over contacting portion 3120, beam portion 3110, beam portion 3150, and surface-mount portion 3130. That is, nickel-based support layer 3172 can be the second plating layer in plating stack 3190, plating stack 3192, plating stack 3194, and plating stack 3196. This nickel-based support layer 3172 can have a thickness of 1.0 micrometers, 2.0 micrometers, 3.0 micrometers, 4.0 micrometers, 0.5 to 1.0 micrometers, 1.0 to 3.0 micrometers, 3.0 to 5.0 micrometers, or more than 5.0 micrometers, or it can have a different thickness or a thickness in a different range of thicknesses.

A first gold flash layer 3174 can be formed over the nickel-based support layer 3172. First gold flash layer 3174 can be plated over contacting portion 3120, beam portion 3110, beam portion 3150, and surface-mount portion 3130. That is, first gold flash layer 3174 can be the third plating layer in plating stack 3190, plating stack 3192, plating stack 3194, and plating stack 3196. This first gold flash layer 3174 can be exposed at a surface-mount portion 3130 or other portion of contact 3100 where contact 3100 is soldered to a board or other substrate (not shown.) This first gold flash layer 3174 can have thickness of 0.02 to 0.05 micrometers, 0.05 to 0.10 micrometers, 0.05 to 0.15 micrometers, 0.15 to 0.30 micrometers, or more than 0.30 micrometers, or it can have a thickness in a different range of thicknesses along a length of a contact. For example, first gold flash layer 3174 can be twice as thick (or flashed twice) in either or both the beam portions 3110 and 3150 of contact 3100.

A first layer of a precious-metal alloy can next be formed on contact 3100. The first precious-metal alloy layer 3176 can be a rhodium alloy, such as rhodium-ruthenium. This layer can alternatively be formed of rhodium, ruthenium, ruthenium alloy, rhodium-iridium, other Pt group elements (palladium, osmium, iridium, and platinum) and their alloys, B540, B541, B563, B589, B683, B685, or B731, titanium, titanium alloy, gold, gold alloy, silver, and silver alloy, other precious metal or its alloys. The first precious-metal-alloy layer 3176 can be plated over the contacting portion 3120 and beam portions 3110 and 3150 of contact 3100. That is, first precious-metal-alloy layer 3176 can be the fourth plating layer in plating stack 3190, plating stack 3192, and plating stack 3194. The first precious-metal-alloy layer 3176 can be omitted from plating stack 3196 over a surface-mount portion 3130 or other portion of contact 3100 where contact 3100 is soldered to a board or other substrate (not shown.) In contacting portion 3120, the first precious-metal-alloy layer 3176 can have a thickness of 1.0 micrometers, 1.75 micrometers, 2.5 micrometers, 0.3 to 1.5 micrometers, 0.5 to 1.0 micrometers, 1.0 to 3.0 micrometers, 2.0 to 4.0 micrometers, or more than 4.0 micrometers, or it can have a different thickness or a thickness in a different range of thicknesses. The first precious-metal-alloy layer 3176 can have a thickness that tapers to a thinner dimension away from contacting portion 3120. This tapering can further help to improve the ductile nature of the plating stacks 3192 and 3194. For example, over beam portion 3110, the first precious-metal-alloy layer 3176 can have a thickness of 0.5 micrometers, 1.25 micrometers, 1.75 micrometers, 0.5 to 1.0 micrometers, 1.0 to 2.5 micrometers, 1.5 to 3.0 micrometers, or more than 3.0 micrometers, or it can have a different thickness or a thickness in a different range of thicknesses near the contacting portion, and it can have a thickness of 0.25 micrometers, 0.55 micrometers, 0.75 micrometers, 0.95 micrometers, 0.2 to 0.6 micrometers, 0.3 to 0.7 micrometers, 0.7 to 2.0 micrometers, or more than 2.0 micrometers, or it can have a different thickness or a thickness in a different range of thicknesses over beam portion 3150.

First gold flash layer 3174 can act as an adhesive for this first precious-metal-alloy layer 3176 in order to adhere the first precious metal alloy layer 3176 to the nickel-based support layer 3172. A second gold flash layer 3178 can be formed over the first precious-metal-alloy layer 3176 on the contacting portion 3120 to allow adhesion of additional layers used to form the very hard plating stack 3190 over contacting portion 3120. This second gold flash layer 3178 and the additional layers may be omitted from a beam portion 3110 and beam portion 3150 to reduce their hardness and increase their flexibility. Also, the first precious-metal-alloy layer 3176 and subsequent layers can be omitted from a surface-mount portion 3130 of contact 3100 to allow for soldering to a board or other substrate (not shown.) This second gold flash layer 3178 can have thickness of 0.02 to 0.05 micrometers, 0.05 to 0.15 micrometers, 0.15 to 0.30 micrometers, or more than 0.30 micrometers, or it can have a thickness in a different range of thicknesses.

A silver, palladium, or silver-palladium based layer 3180 can be formed over the second gold flash layer 3178 over contact portion 3120. This layer can be silver and its alloys, palladium and its alloys, silver-palladium, a ternary silver-palladium-tellurium or quaternary silver-palladium-bismuth-tellurium, palladium-nickel, or other material. This silver or silver-palladium based layer 3180 can be a more reactive layer than subsequent layers formed on its surface. This more reactive layer can take the brunt of corrosive effects while protecting less reactive layers above and below it. To help ensure that this layer absorbs most of the corrosive effects, the silver or silver-palladium based layer 3180 can be formed having a number of micro-cracks or micro-pores in its structure. Further details on these micro-cracks and micro-pores can be found in co-pending U.S. patent application Ser. No. 15/942,408, filed Mar. 30, 2018, titled ELECTRICAL CONTACTS HAVING SACRIFICIAL LAYER FOR CORROSION PROTECTION, which is incorporated by reference. This silver or silver-palladium based layer 3180 can have thickness of less than 1 micrometers, less than 2 micrometers, 2.25 micrometers, 2.5 micrometers, 2.75 micrometers, 0.5 to 1.0 micrometers, 1.0 to 3.0 micrometers, 3.0 to 5.0 micrometers, or more than 5.0 micrometers, or it can have a different thickness or a thickness in a different range of thicknesses. Plating stack 3190 can be used for contacting portions of other types of contacts as well.

A second precious-metal-alloy layer 3182 can be formed on contacting portion 3120 over silver or silver-palladium based layer 3180. This second precious-metal alloy layer

3182 can be formed of the same material as the first precious-metal-alloy layer 3176, or it can be formed of a different material. This layer can alternatively be formed of rhodium, ruthenium, ruthenium alloy, rhodium-iridium, other Pt group elements (palladium, osmium, iridium, and platinum) and their alloys, B540, B541, B563, B589, B683, B685, or B731, titanium, titanium alloy, gold, gold alloy, silver, and silver alloy, other precious metal or its alloys. The second precious-metal alloy layer 3182 can be formed of a rhodium alloy, such as rhodium-ruthenium. The second precious-metal-alloy layer 3182 can form a top plate at the surface of contacting portion 3120. This second precious-metal-alloy layer 3182 can form a surface for the very hard plating stack 3190 on contacting portion 3120 of contact 3100. This second precious-metal-alloy layer 3182 can have a thickness of 1.0 micrometers, 2.0 micrometers, 3.0 micrometers, 4.0 micrometers, less than 1 micrometers, less than 2 micrometers, 0.5 to 1.0 micrometers, 1.0 to 3.0 micrometers, 2.0 to 4.0 micrometers, or more than 4.0 micrometers, or it can have a different thickness or a thickness in a different range of thicknesses.

To avoid cracking of the plating layers at beam portions 3110 and 3150 of contact 3100, this very hard plating stack 3190 can be limited to contacting portion 3120 of contact 3100. Since the beam portions 3110 and 3150 of contact 3100 do not directly form electrical connections, they can be protected with a ductile nonconductive protective layer. This layer can be a nonconductive electrophoretic coating 3184 formed of a base material containing impurities. The impurities can slow corrosion by increasing a total distance corrosive elements must travel through the coating before reaching the plating stack under the electrophoretic coating. In these and other embodiments of the present invention, the base material can be acrylic resin, plastic, or other material. The impurities can be one or more of titanium dioxide, polytetrafluoroethylene, talcum, magnesium oxide, aluminum oxide, calcium oxide, or other inorganic particles. These particles can block corrosion paths through the nonconductive electrophoretic coating, thereby lengthening the corrosion path. This nonconductive electrophoretic coating 3184 can have a thickness of 2.0 to 5.0 micrometers, 3.0 to 10.0 micrometers, 3.0 to 11.0 micrometers, 5.0 to 15.0 micrometers, 10.0 to 20.0 micrometers, or more than 10.0 micrometers, or it can have a thickness in a different range of thicknesses. This electrophoretic coating 3184 can be formed in the same or similar manner as the other electrophoretic coatings described herein.

As with the other examples disclosed herein, one or more of these layers, such as second gold flash layer 3178, can be omitted and one or more other layers can be added.

Figure 32:
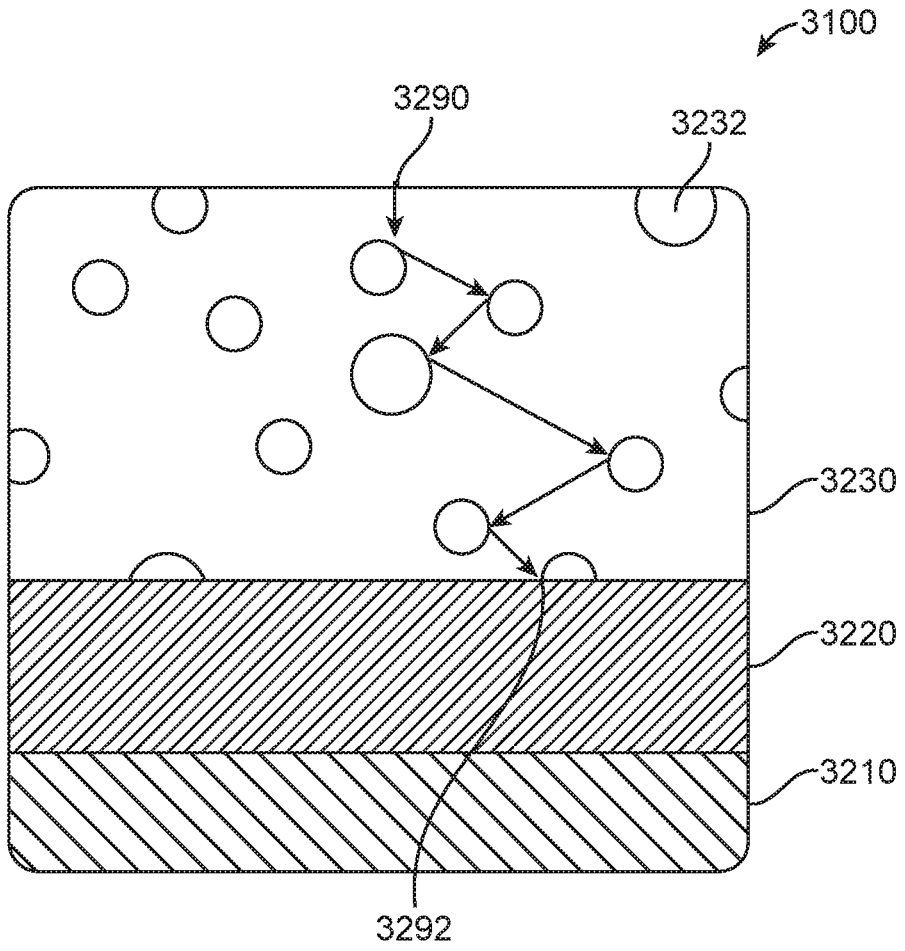
FIG. 32 illustrates a portion of a plating and coating for a contact beam according to an embodiment of the present invention.

FIG. 32 illustrates a portion of a plating and coating for a contact beam according to an embodiment of the present invention. In this example, plating stack 3220 can be formed on contact beam 3210. Electrophoretic coating 3230 can be formed on plating stack 3220. Plating stack 3220 and electrophoretic coating 3230 can be plating stack 3192 or 3194 in FIG. 31, or other plating stack consistent with embodiments of the present invention. Specifically, electrophoretic coating 3230 can be electrophoretic coating 3184 in the example of FIG. 31. Contact beam 3210 can be beam portion 3110 or 3150 of contact 3100 in FIG. 31, or other contact.

Electrophoretic coating 3230 can be formed of acrylic resin, plastic, or other material, and can include one or more various types of impurities 3232. These impurities one or more of titanium dioxide, polytetrafluoroethylene, talcum, magnesium oxide, aluminum oxide, calcium oxide, or other inorganic particles. The presence of these particles can act to increase a length of a corrosion path 3290 as shown. This increased length helps to protect plating stack 3220 from corrosion. Electrophoretic coating 3230 can be ductile such that it does not crack as contacting portion 3120 of contact 3100 engages corresponding contacts in corresponding connectors (not shown.)

Figure 33:
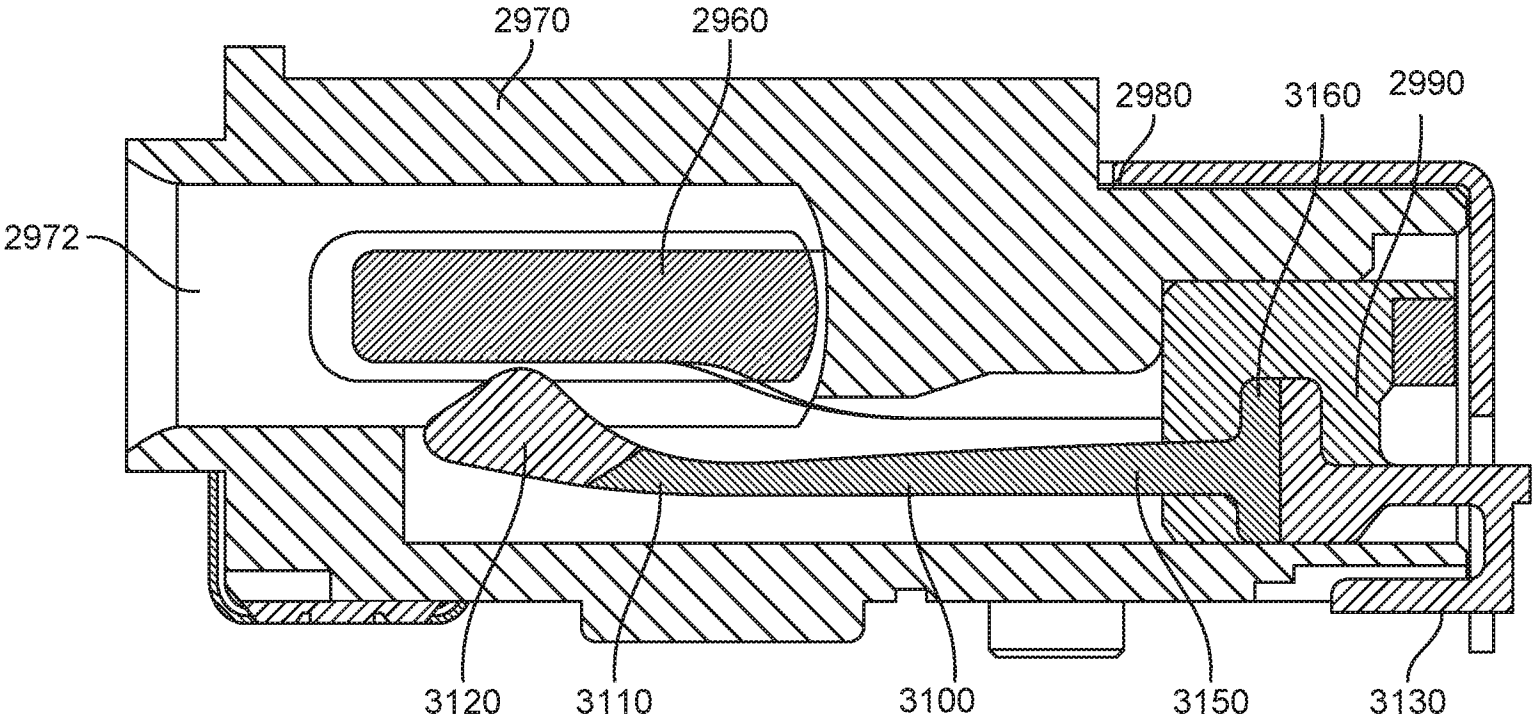
FIG. 33 illustrates a side view of a connector receptacle according to an embodiment of the present invention.

FIG. 33 illustrates a side view of a connector receptacle according to an embodiment of the present invention. This connector receptacle can include an opening 2972 in housing 2970 for receiving a corresponding connector insert (not shown.) Contacts (not shown) on the corresponding connector insert can physically and electrically connect to contacting portions 3120 of contacts 3100. Contact 3100 can further include beam portions 3110 and 3150. Tab 3160 can be housed an injection molded portion 2990. Surface-mount portion 3130 can be soldered to a board or other appropriate substrate. Moisture entering opening 2972 can be prevented from reaching surface-mount portion 3130 by insert molded portion 2990. Side ground contacts 2960 can contact side contacts on the corresponding connector insert when it is inserted into this connector receptacle. Top shield 2980 can help to electrically isolate this connector receptacle.

In practical terms, the plating layers shown in FIG. 31 might not have abrupt edges as shown. Instead, they can taper or merge into one another. An example is shown in the following figure.

Figure 34:
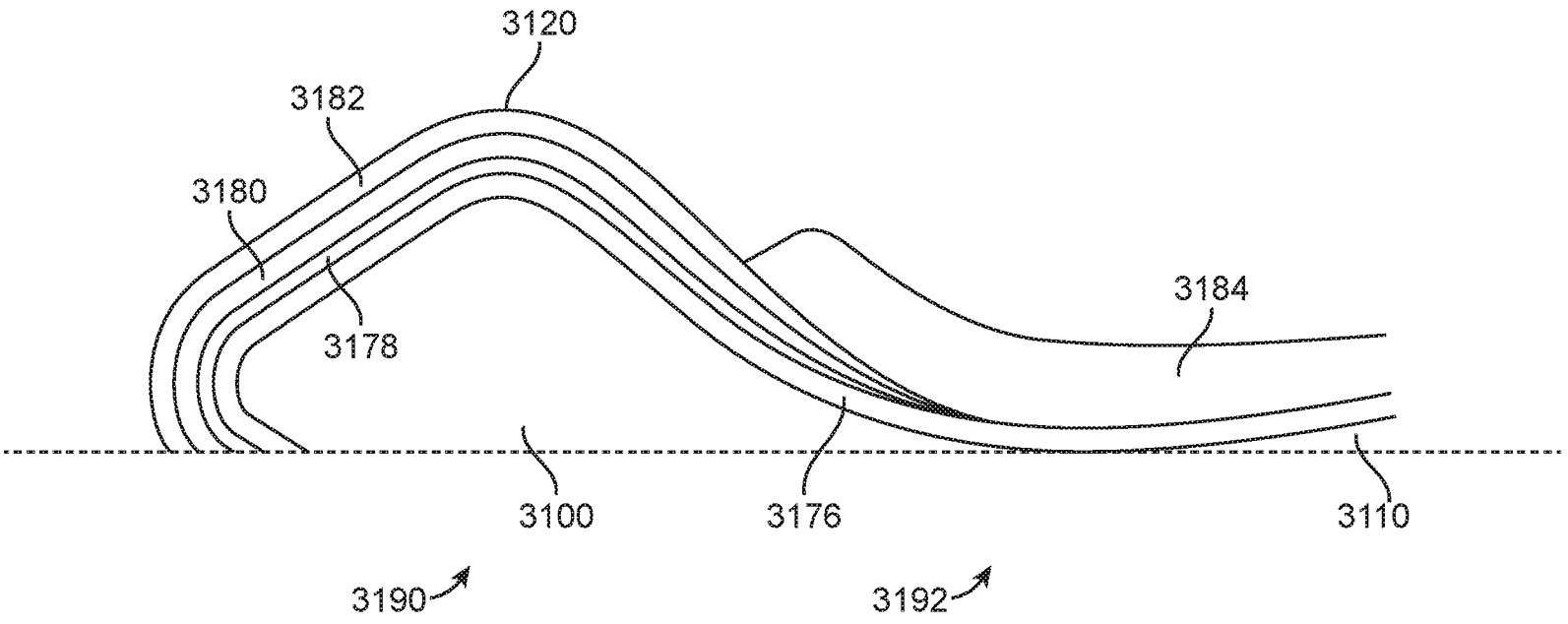
FIG. 34 illustrates a side view of a top edge of a contacting portion of a contact according to an embodiment of the present invention.

FIG. 34 illustrates a side view of a top edge of a contacting portion of a contact according to an embodiment of the present invention. In this example, contacting portion 3120 and nearby beam portion 3110 of contacts 3100 can be plated with a number of layers from plating stacks 3190 and 3192 in FIG. 31. Plating layers 3170, 3172, and 3174 are not shown for simplicity. First precious-metal-alloy layer 3176, the first rhodium-ruthenium layer, can be formed over contacting portion 3120 and can taper to a thinner dimension along beam portion 3110. The second gold flash layer 3178 can be formed over first precious-metal-alloy layer 3176 in contacting portion 3120. The silver or silver-palladium based layer 3180 can be formed over the second gold flash layer 3178. The second precious-metal-alloy layer 3182 can be formed over the silver or silver-palladium based layer 3180, also on contacting portion 3120.

Again, these layers might not extend fully over beam portion 3110 in order to provide a more ductile plating stack for that part of the contact. Accordingly, to protect this part of the contact, an electrophoretic coating 3184 can be used. Electrophoretic coating 3184 can overlap tailing portions of plating layers 3178, 3180, and 3182, as shown. This configuration can provide a very hard plating stack 3190 that is corrosion and wear resistant for contacting portion 3120, while also providing a ductile plating stack 3192 for beam portion 3110.

These and other embodiments of the present invention can reduce the rate of corrosion by using various materials as a substrate for contacts in a connector. The substrate materials can be selected from materials which can provide dimensionally stable anodes in corrosive, applied voltage electrochemical operations. A catalytically active material, also stable in the corrosive application, can be coated on top of the substrate, for example by plating. That is, the present invention can use substrate materials that provide dimensionally stable anodes that are combined with contact coating materials to form a contact in a connector that can be stable even in the presence of high voltage and corrosive environments.

These dimensionally stable anode materials can have electrical resistances that can be higher than copper. This can normally make them poor candidates for electrical contacts. However, where dimensions of a contact substrate are small, the increase in absolute resistance can be limited and the improved corrosion properties provide a significant enough benefit to justify the added resistance.

In these and other embodiments of the present invention, titanium, niobium, tantalum, zirconium, tungsten, or other dimensionally stable anode materials can be used for a substrate. These materials can also be used in alloying to modify mechanical properties without negatively impacting the applied voltage electrochemical resistance of the alloy.

In these and other embodiments of the present invention coating materials can include platinum, gold, ruthenium, rhodium, iridium, and palladium. In these and other embodiments of the present invention oxides of these contact coating and substrate materials can be used. Many of the selected materials form stable oxides which also can survive in highly corrosive environments. These can include titanium dioxide, ruthenium oxide, and palladium oxide. In these and other embodiments of the present invention, the contact coating materials can be used as substrate materials. When these materials are used, additional coatings can be used on the surface of the contact.

In a specific embodiment of the present invention, a contact used in a connector can be formed of a niobium substrate. The substrate can be coated by plating with first a platinum layer, followed by a Gold intermediate layer, and then a top contact layer of rhodium/ruthenium alloy.

In these and other embodiments of the present invention, the non-mating portions of the connector can be encapsulated in a sealed and liquid resistant material, such as an epoxy, so that corrosive materials cannot pass beyond the connector into corrosive materials, such as copper, present behind the corrosion resistant connector.

Several contacts, such as contacts 220, 222, 820, and 1910, are shown in particular contexts. In various embodiments of the present invention, these contacts can be used in other contexts. For example, they can be located at a surface of a device enclosure, in a connector insert, on a connector insert, in a connector receptacle, or in, or on, another contacting structure. Also, while these contacts are shown as having a particular shape, these shapes can vary in these and other embodiments of the present invention.

Several methods of forming contacts are shown herein, such as stamping contacts from copper or some combination of copper and a precious-metal alloy. Also, several plating stacks and methods of plating are shown, as are various form factors for contacts. In various embodiments of the present invention, each of these contacts of various form factors can be formed of copper or some combination of copper and a precious-metal alloy, or other materials, and can be plated with one or more of the various stacks shown herein. For example, contacts, such as contacts 220 can be plated using one or more of the plating stacks 430, 930, 2210, 2610, or other plating stacks according to an embodiment of the present invention. Contacts such as contacts 222 can be plated using one or more of the plating stacks 430, 930, 2210, 2610, or other plating stacks according to an embodiment of the present invention. Contacts such as contacts 820 can be plated using one or more of the plating stacks 430, 930, 2210, 2610, or other plating stacks according to an embodiment of the present invention. Contacts such as contacts 1910 can be plated using one or more of the plating stacks 430, 930, 2210, 2610, or other plating stacks according to an embodiment of the present invention. Other contacts can be plated using one or more of the plating stacks 430, 930, 2210, 2610, or other plating stacks according to an embodiment of the present invention.

While embodiments of the present invention are well-suited to contact structures and their method of manufacturing, these and other embodiments of the present invention can be used to improve the corrosion resistance of other structures. For example, electronic device cases and enclosures, connector housings and shielding, battery terminals, magnetic elements, measurement and medical devices, sensors, fasteners, various portions of wearable computing devices such as clips and bands, bearings, gears, chains, tools, or portions of any of these, can be covered with a precious-metal alloy and plating layers as described herein and otherwise provided for by embodiments of the present invention. The precious-metal alloy and plating layers for these structures can be formed or manufactured as described herein and otherwise provided for by embodiments of the present invention. For example, magnets and other structures for fasteners, connectors, speakers, receiver magnets, receiver magnet assemblies, microphones, and other devices can have their corrosion resistance improved by structures and methods such as those shown herein and in other embodiments of the present invention.

In these and other embodiments of the present invention, including the above contacts, other layers, such as barrier layers to prevent corrosion of internal structures can be included. For example, barrier layers, such as zinc barrier layers, can be used to protect magnets or other internal structures from corrosion by cladding or plating layers. Catalyst layers can be used to improve the rate of deposition for other layers, thereby improving the manufacturing process. These catalyst layers can be formed of palladium or other material. Stress separation layers, such as those formed of copper, can also be included in these and other embodiments of the present invention, including the above contacts. Other scratch protection, passivation, and corrosion resistance layers can also be included.

In various embodiments of the present invention, the components of contacts and their connector assemblies can be formed in various ways of various materials. For example, contacts and other conductive portions can be formed by stamping, metal-injection molding, machining, micro-machining, 3-D printing, or other manufacturing process. The conductive portions can be formed of stainless steel, steel, copper, copper titanium, phosphor bronze, palladium, palladium silver, or other material or combination of materials. They can be plated or coated with nickel, gold, or other material. The nonconductive portions, such as the housings and other portions, can be formed using injection or other molding, 3-D printing, machining, or other manufacturing process. The nonconductive portions can be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention can provide contacts and their connector assemblies that can be located in, and can connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contacts and their connector assemblies can provide pathways for signals that are compliant with various standards such as Universal Serial Bus (USB), High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connectors can be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A contact for a connector, the contact comprising:
a substrate having a contacting portion and a beam;
a plurality of plating layers plated over the substrate; and
a protective layer over the plurality of plating layers, the protective layer over the beam and absent over the contacting portion, the protective layer comprising titanium dioxide particles suspended in a base material.

2. The contact of claim 1 further having a surface-mount portion, wherein the protective layer is absent over the surface-mount portion.

3. The contact of claim 1 wherein the base material consists essentially of an acrylic.

4. The contact of claim 3 wherein the protective layer is formed by electrophoretic deposition.

5. The contact of claim 3 wherein the substrate is one of niobium or tantalum.

6. The contact of claim 3 wherein the substrate is formed primarily of copper.

7. The contact of claim 3 wherein the plurality of plating layers comprises a leveling layer over the substrate, a support layer over the leveling layer, and a first adhesion layer over the support layer.

8. The contact of claim 7 wherein for the beam of the contact, the plurality of plating layers further comprises a first top plate over the first adhesion layer and below the protective layer.

9. The contact of claim 8 wherein for the contacting portion of the contact, the plurality of plating layers further comprises the first top plate over the first adhesion layer, a second adhesion layer over the first top plate, a barrier layer over the second adhesion layer, and a second top plate over the barrier layer.

10. The contact of claim 9 wherein the first adhesion layer is formed of gold and the barrier layer comprises one of palladium, silver, silver-palladium, or silver-palladium-bismuth-tellurium, or silver palladium tellurium.

11. The contact of claim 10 wherein the first and second top plate comprise one of copper, gold, rhodium-ruthenium, rhodium, gold-palladium, gold-cobalt, or gold-copper.

12. A contact for a connector, the contact comprising:
a substrate having a first section and a second section;
a plurality of plating layers plated over the substrate; and
a protective layer over the plurality of plating layers, the protective layer over the first section of the contact and comprising impurities suspended in a base material, wherein the impurities increase an effective corrosion path length through the protective layer from a top surface of the protective layer to a top surface of the plurality of plating layers.

13. The contact of claim 12 wherein the base material consists essentially of an acrylic and the impurities comprise titanium dioxide.

14. The contact of claim 13 wherein the protective layer is formed by electrophoretic deposition.

15. The contact of claim 13 wherein the substrate is one of niobium or tantalum.

16. The contact of claim 13 wherein the contact is formed by stamping.

17. The contact of claim 13 wherein the contact is formed by coining.

18. The contact of claim 12 wherein the protective layer is absent over the second section.

19. The contact of claim 18 further having a third section, wherein the protective layer is absent over the third section.

20. The contact of claim 18 wherein the first section is a beam, the second section is a contacting portion, and the third section is a surface-mount portion.

21. A contact for a connector, the contact comprising:
a substrate;
a first plurality of plating layers over the substrate, the first plurality of plating layers comprising rhodium-ruthenium; and
a second plurality of plating layers over first plurality of layers, the second plurality of plating layers comprising rhodium-ruthenium,
wherein the second plurality of plating layers is plated over a first section of the substrate and the second plurality of plating layers is absent over a second section of the substrate.

22. The contact of claim 21 wherein the first section of the substrate is a contacting portion and the second section of the substrate is a beam.

23. The contact of claim 22 further comprising a protective layer over the second section of the substrate, wherein the protective layer comprises titanium dioxide particles suspended in a base material, where the base material comprises an acrylic.

* * * * *